US010500852B2

(12) United States Patent
Hamano et al.

(10) Patent No.: US 10,500,852 B2
(45) Date of Patent: Dec. 10, 2019

(54) LIQUID JET HEAD AND LIQUID JET DEVICE

(71) Applicant: SII Printek Inc., Chiba-shi, Chiba (JP)

(72) Inventors: Yuichiro Hamano, Chiba (JP); Kazuyoshi Tominaga, Chiba (JP); Takanori Koyano, Chiba (JP); Atsushi Kozuki, Chiba (JP); Kenji Suzuki, Chiba (JP); Masaki Miyagi, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 16/028,954

(22) Filed: Jul. 6, 2018

(65) Prior Publication Data

US 2019/0009536 A1 Jan. 10, 2019

(30) Foreign Application Priority Data

Jul. 10, 2017 (JP) ..... 2017-134993

(51) Int. Cl.
*B41J 2/05* (2006.01)
*B41J 2/14* (2006.01)
*B41J 2/045* (2006.01)

(52) U.S. Cl.
CPC ..... *B41J 2/14145* (2013.01); *B41J 2/0458* (2013.01); *B41J 2/04541* (2013.01); *B41J 2/04563* (2013.01); *B41J 2002/14419* (2013.01)

(58) Field of Classification Search
None
See application file for complete search history.

(56) References Cited

U.S. PATENT DOCUMENTS

2002/0003559 A1* 1/2002 Harajiri ..... B41J 2/14209 347/68
2005/0259127 A1 11/2005 Enomoto et al.
2010/0066784 A1* 3/2010 Hirota ..... B41J 2/04541 347/17

FOREIGN PATENT DOCUMENTS

JP 2014-151539 8/2014
JP 2016-055543 A 4/2016

OTHER PUBLICATIONS

SII Printek Inc, Liquid Jet Head, Liquid Jet Recording Device, and Method for Production of Liquid Jet Head, Apr. 21, 2016, Japan, All Pages (Year: 2016).*
Extended European Search Report for Europe Application No. 18181592.9, dated Nov. 26, 2018, pp. 1-8.

* cited by examiner

*Primary Examiner* — Matthew Luu
*Assistant Examiner* — Tracey M McMillion
(74) *Attorney, Agent, or Firm* — Brinks Gilson & Lione

(57) ABSTRACT

There are provided a liquid jet head and a liquid jet device capable of achieving reduction in size. There are included a first head chip and a second head chip stacked on one another in the Y direction, a first flow channel member disposed on the −Y direction side of the first head chip, and having an inflow port communicated with an ink tank, and a first ink flow channel adapted to communicate the inflow port and the first head chip with each other, a second flow channel member disposed on the +Y direction of the second head chip, and having a second ink flow channel communicated with the second head chip, and a communication flow channel located between the first flow channel member and the second flow channel member, and adapted to communicate the first ink flow channel and the second ink flow channel with each other.

7 Claims, 14 Drawing Sheets

LIQUID JET HEAD AND LIQUID JET DEVICE

RELATED APPLICATIONS

This application claims priority under 35 U.S.C. § 119 to Japanese Patent Application No. 2017-134993 filed on Jul. 10, 2017, the entire content of which is hereby incorporated by reference.

BACKGROUND OF THE INVENTION

1. Field of the Invention

The present invention relates to a liquid jet head and a liquid jet device.

2. Background Art

In the past, there has existed an inkjet printer equipped with an inkjet head as a device for ejecting ink shaped like a droplet to a recording target medium such as recording paper to thereby record an image and characters on the recording target medium. The inkjet head is formed of, for example, a plurality of jet modules corresponding to the respective colors mounted on a carriage.

The jet module described above is provided with a head chip for ejecting ink, a manifold provided with an ink flow channel for supplying the head chip with the ink, and a drive board for driving the head chip, and so on (e.g., JP-A-2014-151539).

In such a configuration, the ink in an ink tank flows in the ink flow channel through an inflow port of the manifold, and is then supplied to the head chip.

Incidentally, there is recently considered a configuration of mounting a plurality of head chips on one jet module in order to make high-resolution printing or high-speed printing possible.

However, on the occasion of adopting the configuration described above, in the case of independently supplying each of the head chips with the ink, it is necessary to provide the inflow ports respectively to the manifolds corresponding to the respective head chips. Therefore, it has been difficult to achieve reduction in size of the jet module.

SUMMARY OF THE INVENTION

The invention is made taking the above circumstances into consideration, and has an object of providing a liquid jet head and a liquid jet device capable of achieving reduction in size.

In order to solve the problem described above, a liquid jet head according to an aspect of the invention includes a first head chip and a second head chip stacked on one another in a first direction, and each adapted to jet liquid, a first flow channel member disposed on an opposite side of the first head chip to the second head chip in the first direction and including an inflow port communicated with a supply source of the liquid, and a first liquid flow channel adapted to communicate the inflow port and the first head chip with each other, a second flow channel member disposed on an opposite side of the second head chip to the first head chip in the first direction, and including a second liquid flow channel communicated with the second head chip, and a communication flow channel located between the first flow channel member and the second flow channel member, and adapted to communicate the first liquid flow channel and the second liquid flow channel with each other.

According to this configuration, a part of the liquid having flown into the first liquid flow channel through the inflow port is supplied to the first head chip. Meanwhile, a part of the liquid having flown into the first liquid flow channel is supplied to the second liquid flow channel and the second head chip through the communication flow channel.

As described above, in the present aspect, since the first liquid flow channel and the second liquid flow channel are communicated with each other through the communication flow channel, it is possible to supply the liquid to the two head chips through the single inflow port. Thus, it becomes possible to reduce the size compared to the case of supplying the liquid to the respective head chips through separate inflow ports.

In the liquid jet head according to the above aspect of the invention, it is possible that the communication flow channel is a penetration hole adapted to penetrate the first head chip and the second head chip in the first direction.

According to the present aspect of the invention, an increase in the number of components can be suppressed compared to the case of providing the communication flow channels separately from the head chips. Further, it is possible to shorten the flow channel length of the communication flow channel to thereby reduce the pressure loss in the communication flow channel.

In the liquid jet head according to the above aspect of the invention, it is possible that the first flow channel member supports a drive board adapted to drive any of the first head chip and the second head chip.

According to the present aspect of the invention, both of the head chip and the drive board are supported by the first flow channel member having the first liquid flow channel. Therefore, it becomes possible to reduce the size in the first direction of the liquid jet head compared to the case of, for example, separately disposing the drive board and the first flow channel member on the both sides in the first direction across the head chip from each other.

Further, since the head chip and the drive board are supported by the first flow channel member, it results that the heat generated in the head chip and the drive board is radiated outside via the first flow channel member. Thus, it is possible to ensure the heat radiation performance of the head chip and the drive board.

Further, since the head chip and the drive board are supported by the first flow channel member having the first liquid flow channel, it is also possible to heat the liquid flowing through the first liquid flow channel using the exhaust heat generated in the head chip and the drive board and then transmitted to the first flow channel member. Thus, it is possible to supply the liquid to the head chip at desired temperature (viscosity), and thus, excellent print characteristics can be obtained.

In the liquid jet head according to the above aspect of the invention, it is possible that a first driver adapted to drive the first head chip and a second driver adapted to drive the second head chip are mounted on the drive board, the first head chip and the first driver are electrically connected to each other via the drive board, and the second head chip and the second driver are electrically connected to each other via a wiring board branched from the drive board.

According to the present aspect of the invention, it is possible to achieve simplification and miniaturization of the configuration compared to the case of providing the drive board on which the drivers are mounted for each of the head chips.

In the liquid jet head according to the above aspect of the invention, it is possible that a temperature sensor adapted to detect a temperature of the liquid is installed in the second flow channel member.

According to the present aspect of the invention, since it is possible to dispose the temperature sensor at a position adjacent to the head chip, the liquid temperature in the head chip can accurately be detected.

In particular, since the temperature sensor is installed in the second flow channel member, it is possible to prevent the heat of the drive board supported by the first flow channel member from affecting the temperature sensor. Therefore, the liquid temperature can more accurately be detected.

In the liquid jet head according to the above aspect of the invention, it is possible that the first head chip includes a first actuator plate provided with a jet channel into which the liquid inflows, and a first cover plate stacked on the first actuator plate in the first direction, and provided with a liquid chamber adapted to connect the jet channel and the first liquid flow channel to each other, and the second head chip includes a second actuator plate provided with a jet channel into which the liquid inflows, and stacked on the first actuator plate on an opposite side to the first cover plate in the first direction, and a second cover plate stacked on the second actuator plate in the first direction, and provided with a liquid chamber adapted to connect the jet channel and the second liquid flow channel to each other.

According to the present aspect of the invention, the liquid flowing through the liquid flow channels inflows into the jet channel of the head chips through the liquid chambers of the corresponding head chips, respectively. In this case, since the capacity of the part (the liquid chamber) from the liquid flow channel to the jet channel can be set equivalent between the head chips, it is possible to equalize the jet characteristics of the head chips.

A liquid jet device according to another aspect of the invention is provided with the liquid jet head according to any one of the aspects of the invention described above.

According to the present aspect of the invention, it is possible to provide a liquid jet device small in size.

According to an aspect of the invention, it is possible to achieve reduction in size of the liquid jet head and the liquid jet device.

DETAILED DESCRIPTION OF THE INVENTION

Figure 1:
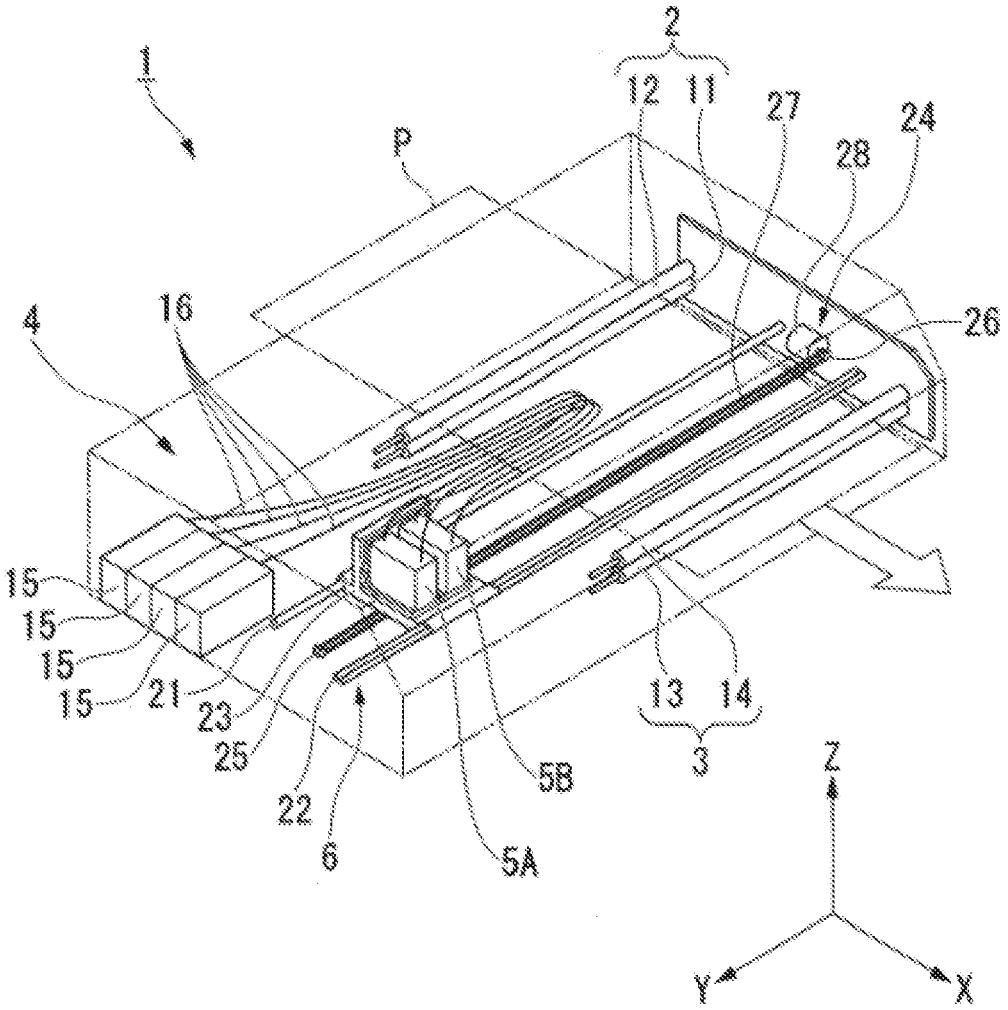
FIG. 1 is a schematic configuration diagram of an inkjet printer according to an embodiment of the invention.

An embodiment according to the invention will hereinafter be described with reference to the accompanying drawings. In the following embodiment, the description will be presented citing an inkjet printer (hereinafter simply referred to as a printer) for performing recording on a recording target medium using ink (liquid) as an example. It should be noted that the scale size of each member is accordingly modified so as to provide a recognizable size in the drawings used in the following description.

[Printer]

FIG. 1 is a schematic configuration diagram of a printer 1.

As shown in FIG. 1, the printer 1 according to the present embodiment is provided with a pair of conveying mechanisms 2, 3, an ink supply mechanism 4, inkjet heads 5A, 5B, and a scanning mechanism 6. It should be noted that in the following explanation, the description is presented using a Cartesian coordinate system of X, Y, and Z as needed. In this case, the X direction coincides with the conveying direction (a sub-scanning direction) of a recording target medium P (e.g., paper). The Y direction (a first direction) coincides with a scanning direction (a main scanning direction) of the scanning mechanism 6. The Z direction is a height direction (a gravitational direction) perpendicular to the X direction and the Y direction. In the following explanation, the description will be presented defining the arrow direction as the positive (+) direction, and a direction opposite to the arrow direction as the negative (−) direction in the drawings in each of the X direction, the Y direction, and the Z direction. In the present embodiment, the +Z direction corresponds to an upward direction in the gravitational direction, and the −Z direction corresponds to a downward direction in the gravitational direction.

The conveying mechanisms 2, 3 convey the recording target medium P in the +X direction. Specifically, the conveying mechanism 2 is provided with a grit roller 11 extending in the Y direction, a pinch roller 12 extending in parallel to the grit roller 11, and a drive mechanism (not shown) such as a motor for making axial rotation of the grit roller 11. Similarly, the conveying mechanism 3 is provided with a grit roller 13 extending in the Y direction, a pinch roller 14 extending in parallel to the grit roller 13, and a drive mechanism (not shown) for making axial rotation of the grit roller 13.

The ink supply mechanism 4 is provided with ink tanks 15 each housing the ink, and ink pipes 16 for respectively connecting the ink tanks 15 and the inkjet heads 5A, 5B to each other.

In the present embodiment, the ink tanks 15 are arranged in the X direction. The ink tanks 15 respectively house four colors of ink such as yellow ink, magenta ink, cyan ink, and black ink.

The ink pipes 16 are each, for example, a flexible hose having flexibility. The ink pipes 16 connect the ink tanks 15 and the inkjet heads 5A, 5B to each other.

The scanning mechanism 6 reciprocates the inkjet heads 5A, 5B in the Y direction. Specifically, the scanning mechanism 6 is provided with a pair of guide rails 21, 22, a carriage 23, and a drive mechanism 24, wherein the pair of guide rails 21, 22 extend in the Y direction, the carriage 23 is movably supported by the pair of guide rails 21, 22, and the drive mechanism 24 moves the carriage 23 in the Y direction.

The drive mechanism 24 is disposed between the guide rails 21, 22 in the X direction. The drive mechanism 24 is provided with a pair of pulleys 25, 26, an endless belt 27, and a drive motor 28, wherein the pair of pulleys 25, 26 are disposed in the Y direction with a distance, the endless belt 27 is wound between the pair of pulleys 25, 26, and the drive motor 28 rotationally drives the pulley 25 as one of the pulleys 25, 26.

The carriage 23 is connected to the endless belt 27. On the carriage 23, there are mounted the plurality of inkjet heads 5A, 5B in the state of being arranged side by side in the Y direction. The inkjet heads 5A, 5B are arranged so that two colors of ink can be ejected from each of the inkjet heads 5A, 5B. Therefore, in the printer 1 according to the present embodiment, there is adopted the configuration in which the inkjet heads 5A, 5B each eject the two colors of ink, wherein the two colors of ink ejected by the inkjet head 5A are different from the two colors of ink ejected by the inkjet head 5B, and thus, the four colors of ink, namely the yellow ink, the magenta ink, the cyan ink, and the black ink, can be ejected.

<Inkjet Head>

Figure 2:
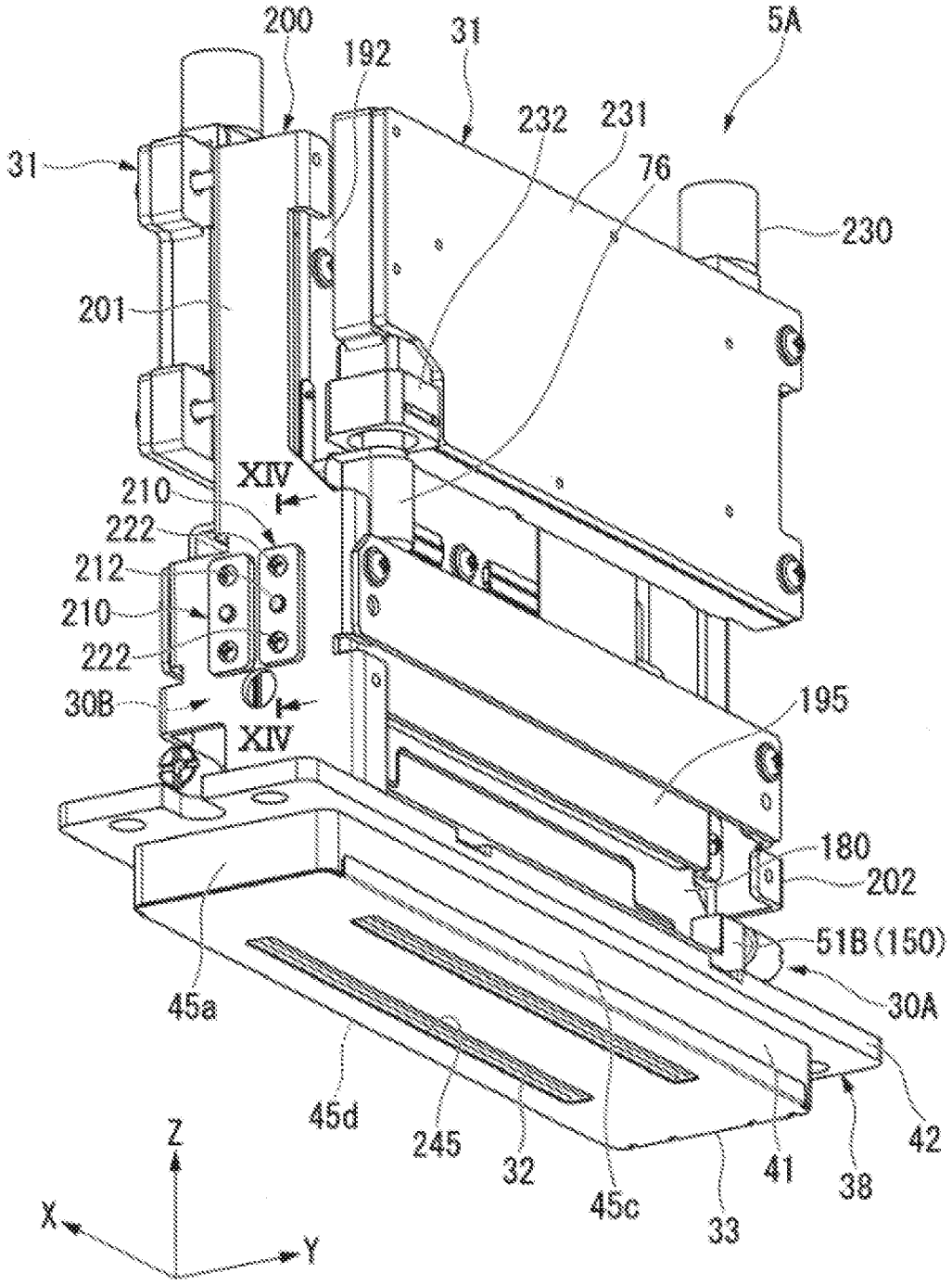
FIG. 2 is a perspective view of an inkjet head according to the embodiment.
Figure 3:
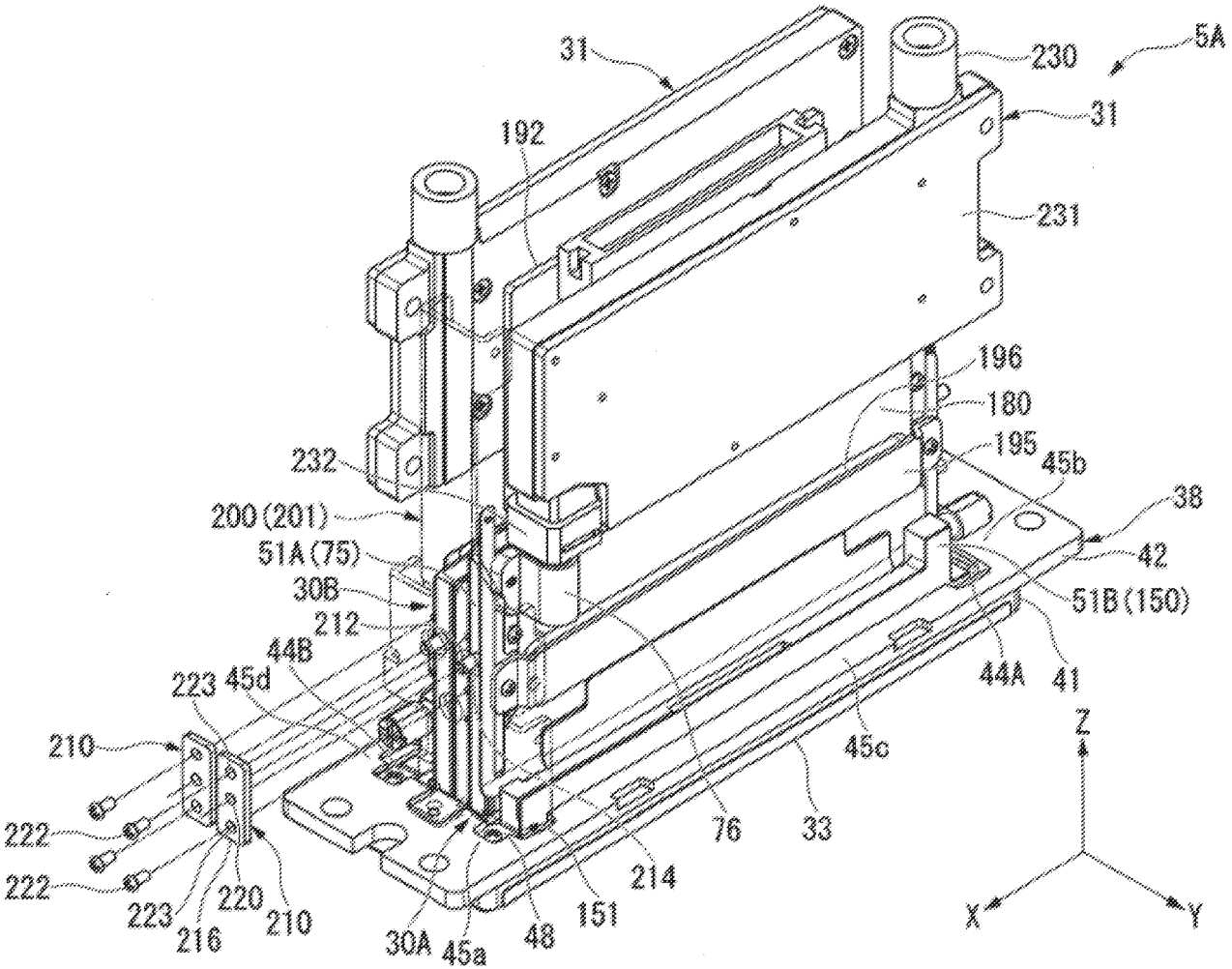
FIG. 3 is a partially exploded perspective view of the inkjet head according to the embodiment.

FIG. 2 is a perspective view of the inkjet head 5A. FIG. 3 is a partially exploded perspective view of the inkjet head 5A. It should be noted that the inkjet heads 5A, 5B have equivalent configurations except the colors of the ink supplied. Therefore, in the following explanation, the inkjet head 5A will be described, and the description of the inkjet head 5B will be omitted.

As shown in FIG. 2 and FIG. 3, the inkjet head 5A according to the present embodiment is constituted by jet modules 30A, 30B (see FIG. 3), dampers 31, a nozzle plate 32 (see FIG. 2), a nozzle guard 33, and so on mounted on a base member 38.

(Base Member)

Figure 4:
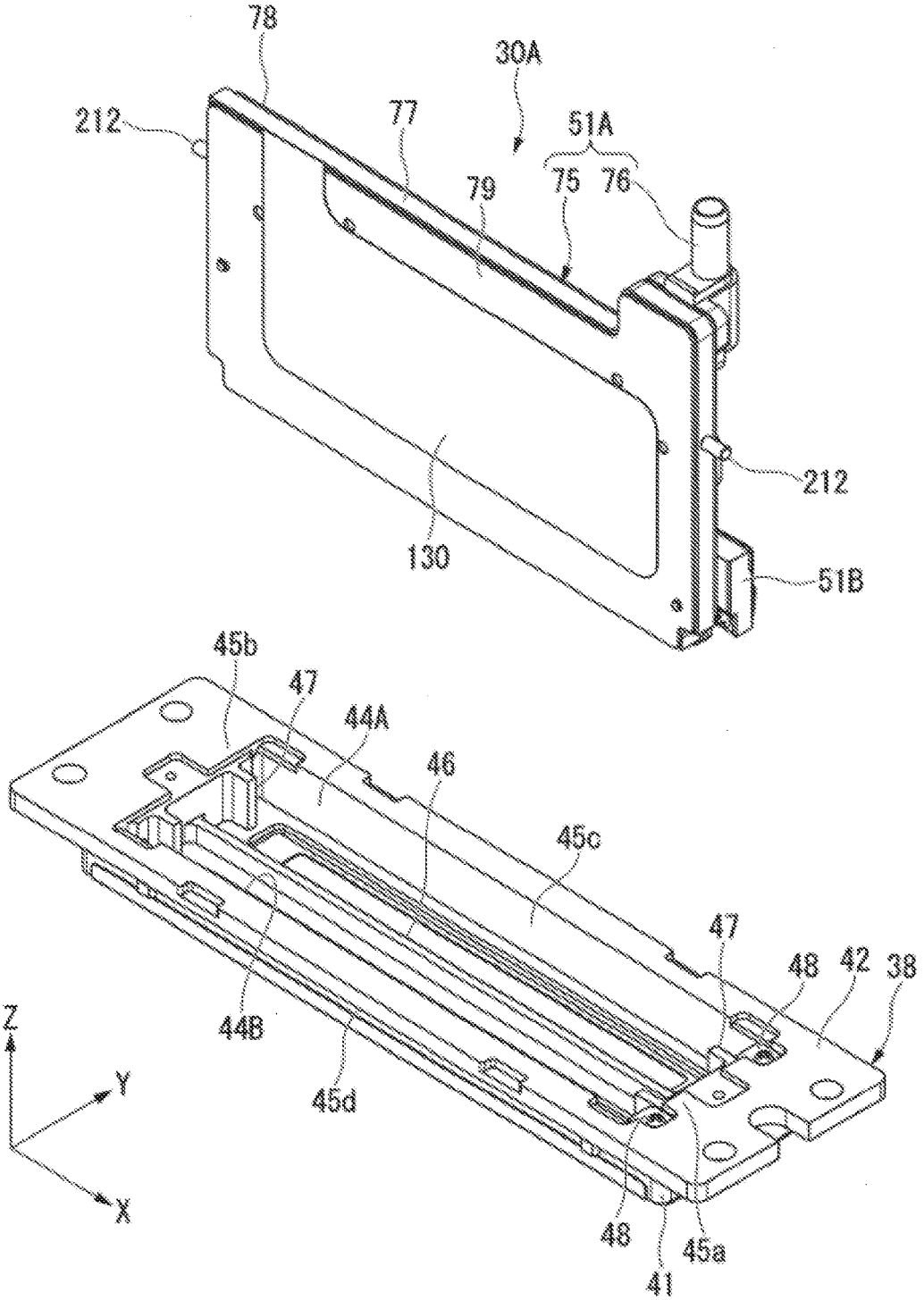
FIG. 4 is an exploded perspective view of a base member and a first jet module in the inkjet head according to the embodiment.

FIG. 4 is an exploded perspective view of the base member 38 and the first jet module 30A in the inkjet head 5A.

As shown in FIG. 4, the base member 38 is formed to have a plate-like shape the thickness direction of which is the Z direction, and the longitudinal direction of which is the X direction. The base member 38 has a base main body part 41 for holding the jet modules 30A, 30B, and a carriage fixation section 42 for fixing the base member 38 to the carriage 23 (see FIG. 1). It should be noted that in the present embodiment, the base member 38 is formed of a metal material as a single body.

The base main body part 41 is provided with module housing sections (a first module housing section 44A and a second module housing section 44B). The two module housing sections 44A, 44B are formed so as to be arranged side by side in the Y direction corresponding respectively to the jet modules 30A, 30B. Each of the module housing sections 44A, 44B penetrates the base main body part 41 in the Z direction. It is arranged that it is possible to insert the jet modules 30A, 30B corresponding respectively to the module housing sections 44A, 44B into the respective module housing sections 44A, 44B. Specifically, the −Z direction-end parts of the jet modules 30A, 30B are inserted into the respective module housing sections 44A, 44B, and thus, the jet modules 30A, 30B are held by the base main body part 41 in the state of rising from the base member 38 toward the +Z direction.

In the base main body part 41, in a part located between the module housing sections 44A, 44B, there is formed a partition part 46 for partitioning between the module housing sections 44A, 44B. A pair of short side parts 45*a*, 45*b* opposed to each other in the X direction in the base main body part 41 are each provided with projection walls 47 projecting inward in the X direction. The projection walls 47 opposed to each other in the X direction make a set, and are formed for each of the module housing sections 44A, 44B.

The first short side part 45*a* is provided with first biasing members 48. The first biasing members 48 are disposed corresponding respectively to the module housing sections 44A, 44B. Each of the first biasing members 48 is formed to have a shape of a plate spring intervening between the first short side part 45*a* and each of the jet modules 30A, 30B. The first biasing members 48 bias the respective jet modules 30A, 30B toward the second sort side part 45*b* (the −X direction).

The carriage fixation section 42 projects from the +Z direction end part of the base main body part 41 in the X-Y plane. The carriage fixation section 42 is provided with attachment holes for attaching the base member 38 to the carriage 23 (see FIG. 1) and so on.

(Jet Modules)

As shown in FIG. 3, the jet modules 30A, 30B are each formed to have a plate-like shape the thickness direction of which is the Y direction. The jet modules 30A, 30B are each configured so as to be able to eject the ink supplied from the ink tank 15 (see FIG. 1) toward the recording target medium P. The jet modules 30A, 30B are mounted on the base member 38 at an interval in the Y direction.

In the inkjet head 5A according to the present embodiment, it is arranged that each of the jet modules 30A, 30B ejects the ink of one color. It should be noted that the number of the jet modules 30A, 30B mounted on the base member 38, and the colors and types of the ink ejected by the jet modules 30A, 30B can arbitrarily be changed. The jet modules 30A, 30B are the jet modules having the same configuration, and are mounted on the base member 38 in respective orientations opposite in the Y direction to each other. Therefore, in the following configuration, the description will be presented taking the first jet module 30A as an example.

Figure 5:
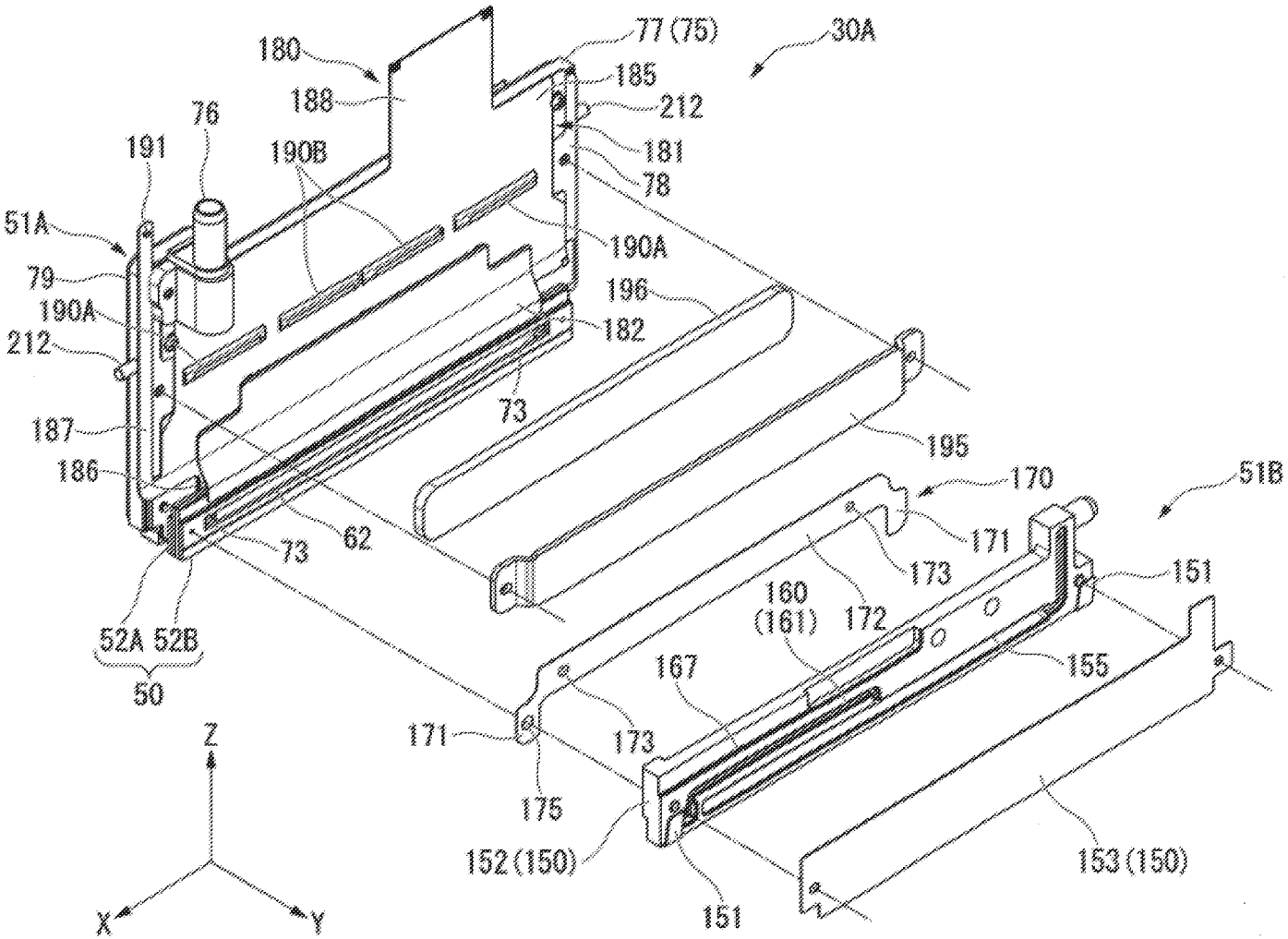
FIG. 5 is an exploded perspective view of the first jet module according to the embodiment.

FIG. 5 is an exploded perspective view of the first jet module 30A.

As shown in FIG. 5, the first jet module 30A is mainly provided with an ejection section 50, and a first flow channel member 51A and a second flow channel member 51B opposed in the Y direction across the ejection section 50 from each other.

(Ejection Section)

Figure 6:
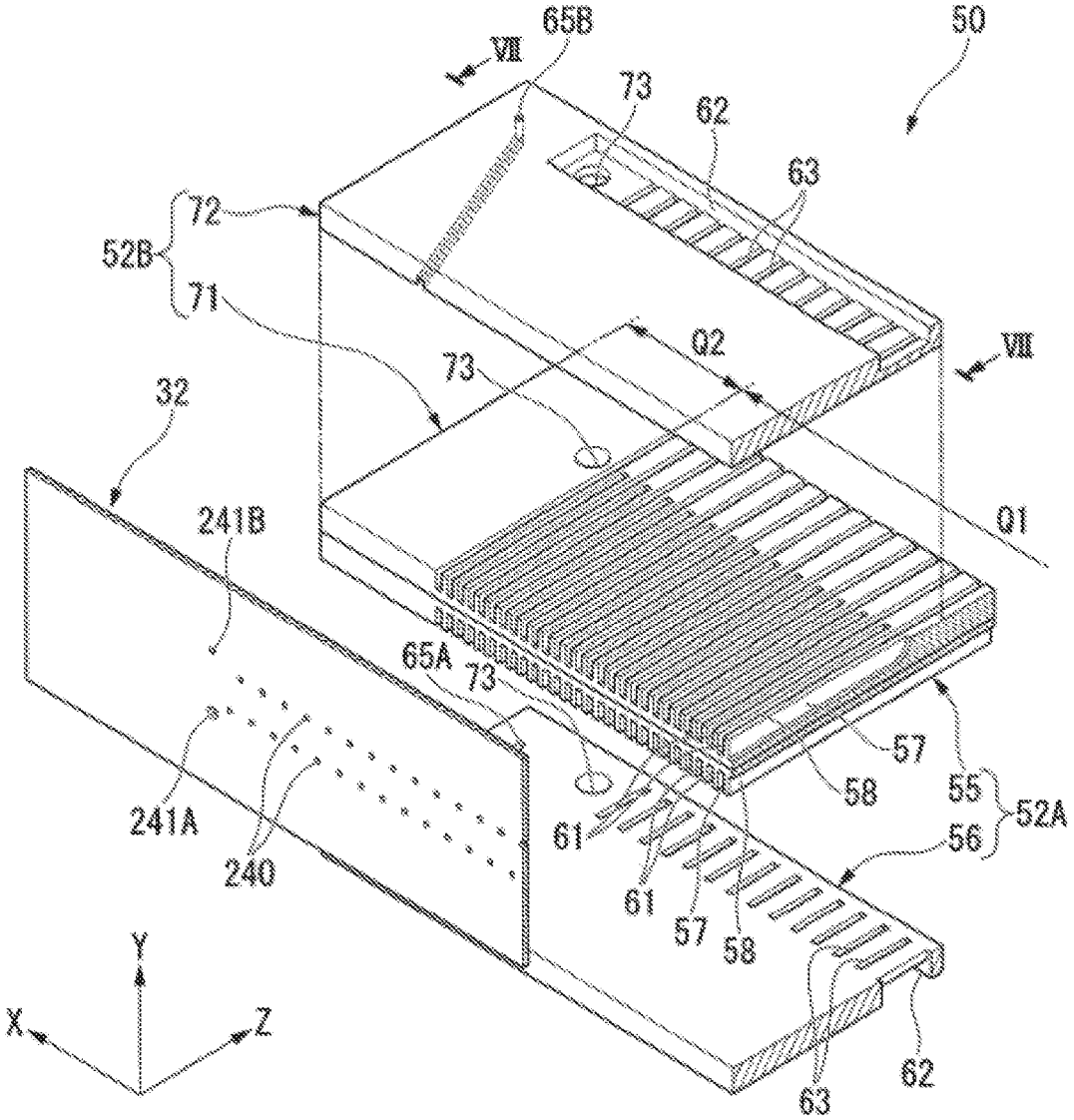
FIG. 6 is an exploded perspective view of an ejection section according to the embodiment.

FIG. 6 is an exploded perspective view of the ejection section 50.

As shown in FIG. 6, the ejection section 50 has a first head chip 52A, and a second head chip 52B stacked in the +Y direction on the first head chip 52A. Each of the head chips 52A, 52B is of a so-called edge-shoot type for ejecting the ink from an end part in the extending direction (the Z direction) of an ejection channel 57 described later.

The first head chip 52A is formed of a first actuator plate 55 and a first cover plate 56 overlapped in the Y direction with each other.

The first actuator plate 55 is a piezoelectric substrate formed of PZT (lead zirconate titanate) or the like. In the first actuator plate 55, the polarization direction is set to one direction along the thickness direction (the Y direction). It should be noted that the first actuator plate 55 can also be formed of two piezoelectric substrates having the respective polarization directions different in the Y direction stacked on one another (a so-called chevron type).

The first actuator plate 55 is provided with a plurality of channels 57, 58 opening in a surface (hereinafter referred to as an "obverse surface") facing to the −Y direction, the channels 57, 58 being arranged in the X direction in parallel to each other at intervals. The channels 57, 58 are each formed linearly along the Z direction. Each of the channels 57, 58 opens on the end surface in the −Z direction in the first actuator plate 55. It should be noted that it is also possible for each of the channels 57, 58 to extend obliquely to the Z direction.

Figure 7:
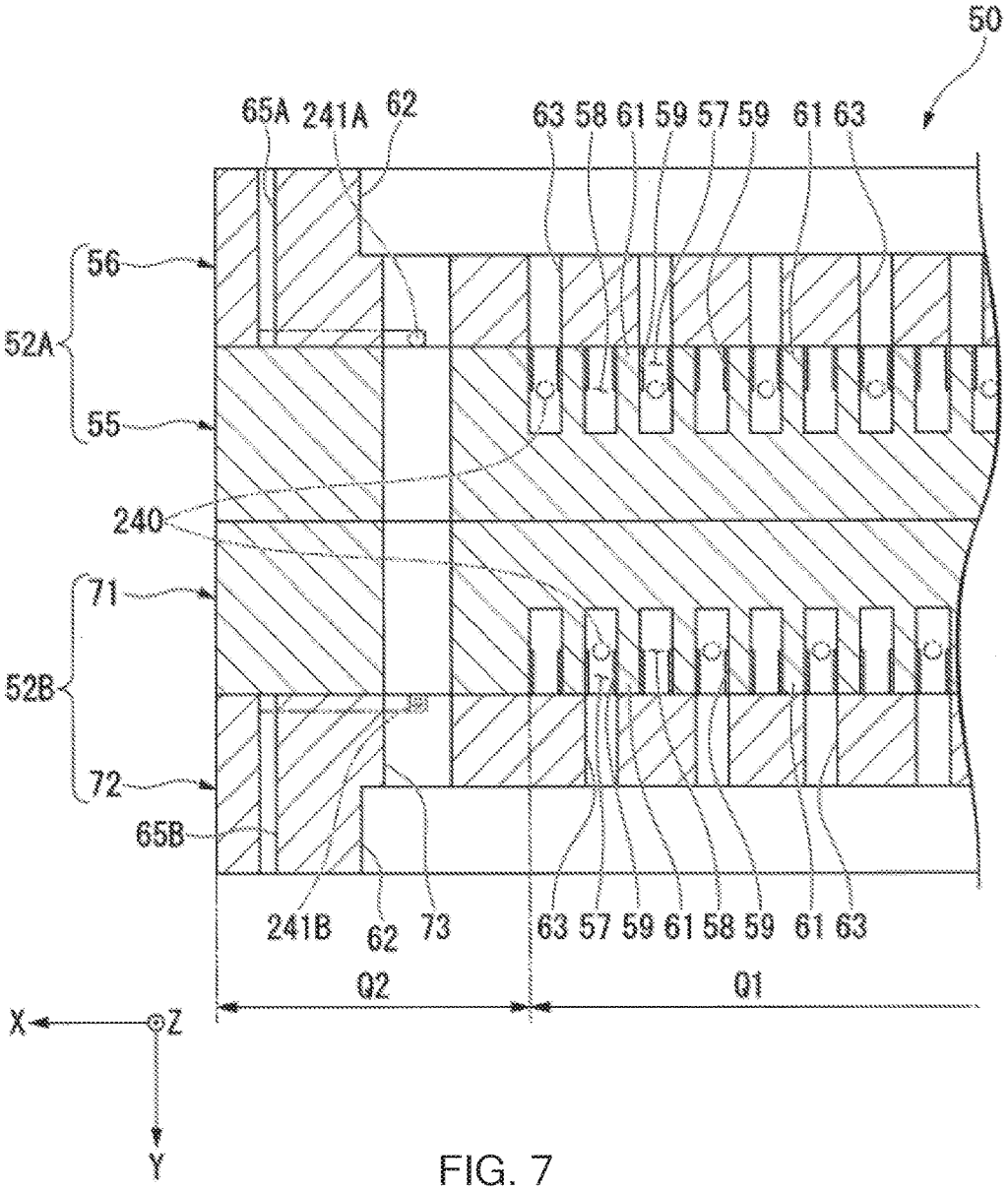
FIG. 7 is a cross-sectional view along the line VII-VII shown in FIG. 6.

FIG. 7 is a cross-sectional view along the line VII-VII shown in FIG. 6.

As shown in FIG. 6 and FIG. 7, the plurality of channels 57, 58 consist of ejection channels 57 filled with the ink, and non-ejection channels 58 not filled with the ink. The ejection channels 57 and the non-ejection channels 58 are alternately arranged along the X direction. The channels 57, 58 are partitioned in the X direction by drive walls 61 formed of the first actuator plate 55. It should be noted that on inner surfaces of each of the channels 57, 58, there are formed drive electrodes 59. Each of the drive electrodes 59 is connected to a drive terminal (not shown) formed on a surface of the first actuator plate 55 in the +Z direction end part of the first actuator plate 55.

The first cover plate 56 is formed so as to have a rectangular shape in a planar view viewed from the Y direction. The first cover plate 56 is bonded to the surface of the first actuator plate 55 in a state in which the +Z direction end part of the first actuator plate 55 is projected (see FIG. 10).

The first cover plate 56 has a common ink chamber 62 opening in a surface (hereinafter referred to as an "obverse surface") facing to the −Y direction, and a plurality of slits 63 opening in a surface (hereinafter referred to as a "reverse surface") facing to the +Y direction.

The common ink chamber 62 is formed at a position corresponding to the +Z direction end parts of the ejection channels 57 in the Z direction. The common ink chamber 62 is recessed toward the +Y direction from the obverse surface of the first cover plate 56, and at the same time extends in the X direction. In the common ink chamber 62, the ink flows through the first flow channel member 51A described above.

The slits 63 are formed at positions opposed in the Y direction to the respective ejection channels 57 in the common ink chamber 62. The slits 63 respectively communicate the inside of the common ink chamber 62 and the inside of the ejection channels 57 with each other. Therefore, the non-ejection channels 58 are not communicated with the inside of the common ink chamber 62.

In a part of the first cover plate 56 located on the outer side of the common ink chamber 62 in the X direction, there are formed a pair of first bubble-vent holes 65A. Each of the first bubble-vent holes 65A penetrates the first cover plate 56 in the Y direction, and then extends between the first cover plate 56 and the first actuator plate 55 in the −Z direction. In other words, out of the first bubble-vent holes 65A, the first opening part opens in the obverse surface of the first cover plate 56, and the second opening part opens in the −Z direction end surface of the first head chip 52A.

The second head chip 52B is formed of a second actuator plate 71 and a second cover plate 72 overlapped in the Y direction with each other. In the following description, the constituents in the second head chip 52B substantially the same as those of the first head chip 52A are denoted by the same reference symbols as in the first head chip 52A, and the description thereof will be omitted.

The second actuator plate 71 is bonded to a surface (hereinafter referred to as a "reverse surface") of the first actuator plate 55 facing to the +Y direction. The ejection channels 57 and the non-ejection channels 58 of the second head chip 52B are arranged so as to be shifted as much as a half pitch with respect to the arrangement pitch of the ejection channels 57 and the non-ejection channels 58 of the first head chip 52A from the ejection channels 57 and the non-ejection channels 58 of the first head chip 52A. In other words, the ejection channels 57 of the head chips 52A, 52B, and the non-ejection channels 58 of the head chips 52A, 52B are each arranged in a zigzag manner.

The second cover plate 72 is bonded to a surface (hereinafter referred to as an "obverse surface") of the second actuator plate 71 facing to the +Y direction. In a part of the second cover plate 72 located on at least the +X direction side of the common ink chamber 62, there is formed a second bubble-vent hole 65B. The second bubble-vent hole 65B penetrates the second cover plate 72 in the Y direction, and then extends between the second cover plate 72 and the second actuator plate 71 in the −Z direction.

In the ejection section 50, an area where the channels 57, 58 are arranged is defined as an ejection area Q1, and areas (areas on the outer sides of the outermost channels 57, 58) located on both sides in the X direction of the ejection area Q1 are defined as a pair of non-ejection areas Q2. In the non-ejection areas Q2, there are respectively formed communication holes 73 (one of the communication holes 73 is shown alone in FIGS. 6 and 7) penetrating the ejection section 50 (the head chips 52A, 52B) in the Y direction. The communication holes 73 each penetrate the head ships 52A, 52B (the actuator plates 55, 71, and the cover plates 56, 72) in the Y direction to communicate the common ink chambers 62 of the head chips 52A, 52B with each other. It should be noted that the number, the positions, the shapes, and so on of the communication holes 73 can arbitrarily be changed.

(First Flow Channel Member)

Figure 8:
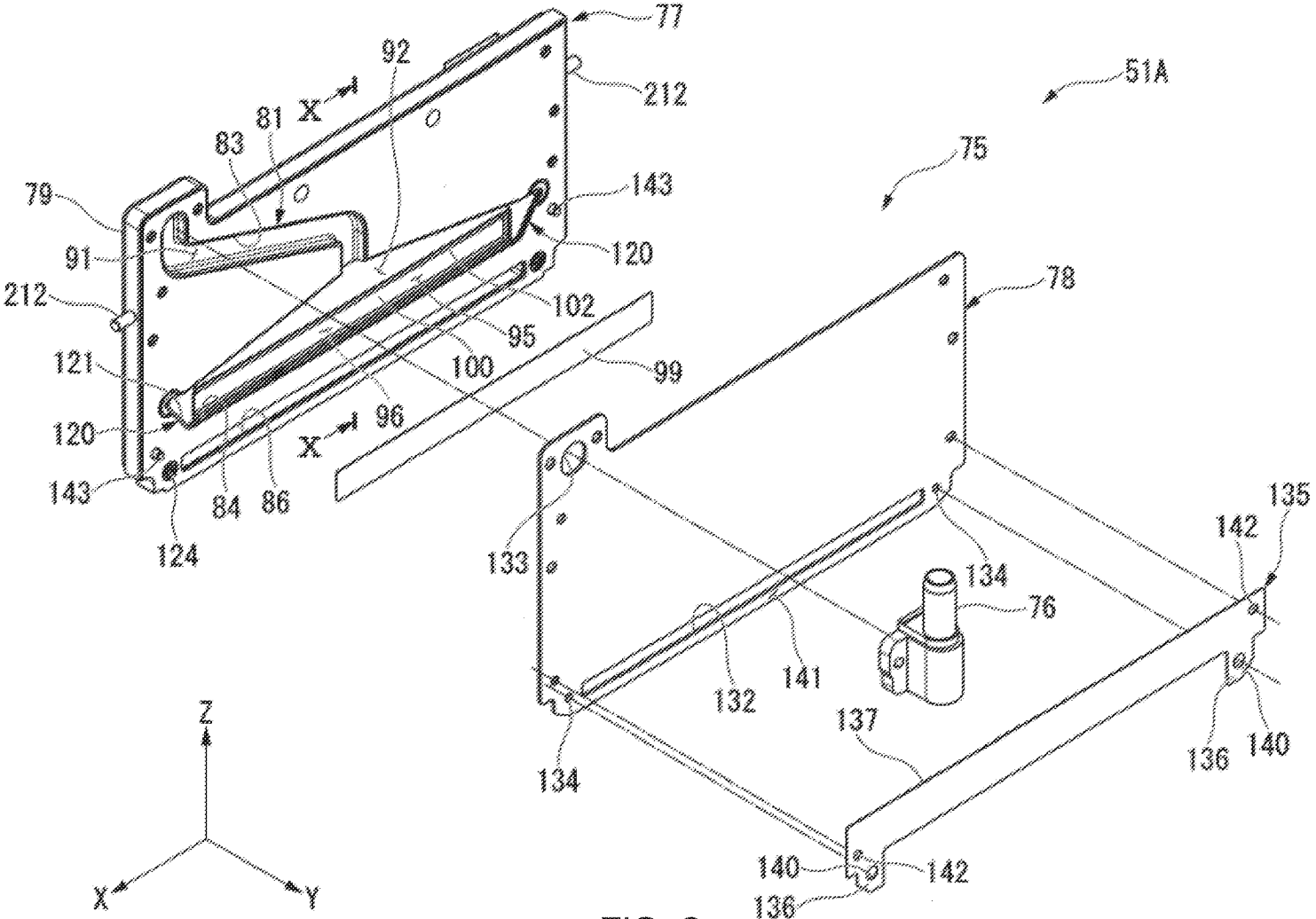
FIG. 8 is an exploded perspective view of a first flow channel member according to the embodiment developed in a +Y direction from a first flow channel plate.

FIG. 8 is an exploded perspective view of the first flow channel member 51A developed in the +Y direction from a first flow channel plate 77.

As shown in FIG. 8, the first flow channel member 51A has a first manifold 75 and an inflow port 76. It should be noted that the first manifold 75 and the inflow port 76 can also be formed integrally with each other.

The first manifold 75 is formed to have a plate-like shape the thickness direction of which is the Y direction as a whole. As shown in FIG. 3, the −Z direction end part of the first manifold 75 is inserted into the first module housing section 44A described above, and thus, the first manifold 75 is held by the base member 38 in the state of rising in the +Z direction.

As shown in FIG. 8, the first manifold 75 has the first flow channel plate 77, a front cover 78 disposed on the +Y direction side with respect to the first flow channel plate 77, and a rear cover 79 disposed on the −Y direction side with respect to the first flow channel plate 77.

The first flow channel plate 77 is formed of a material excellent in thermal conductivity. In the present embodiment, as the material of the first flow channel plate 77, a metal material (e.g., aluminum) is preferably used. The first flow channel plate 77 is provided with a first ink flow channel 81 through which the ink flows toward the first head chip 52A.

Figure 9:
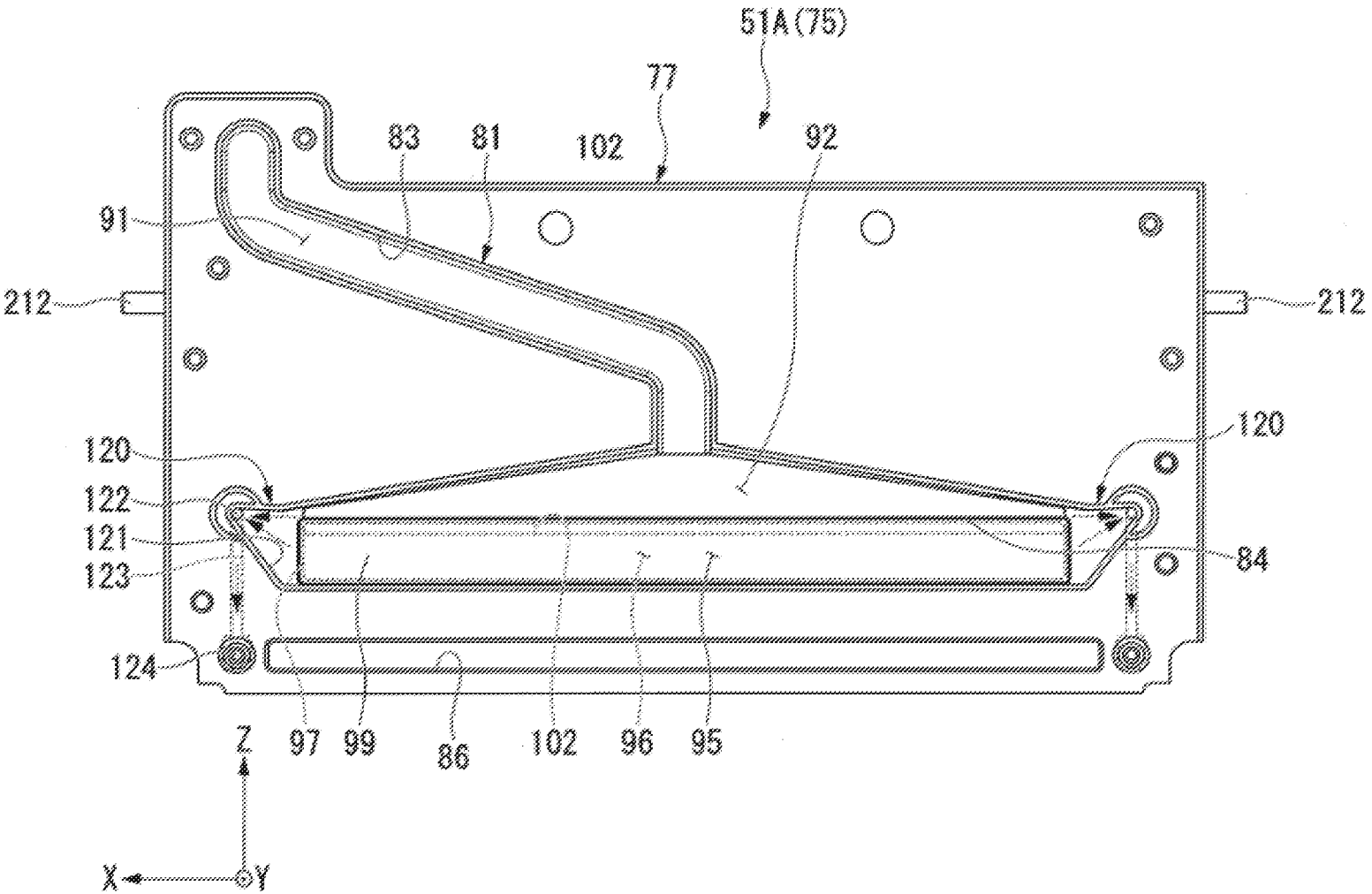
FIG. 9 is a front view of the first flow channel plate according to the embodiment viewed from the +Y direction.

FIG. 9 is a front view of the first flow channel plate 77 viewed from the +Y direction.

As shown in FIG. 8 and FIG. 9, the first ink flow channel 81 is formed of an upstream flow channel 83, a filtration flow channel 84, a downstream flow channel 85 and a supply flow channel 86 (see FIG. 11) connected to one another.

The upstream flow channel 83 opens in the +Y direction in the first flow channel plate 77. Specifically, the upstream flow channel 83 has a narrow width flow channel 91, and a connecting flow channel 92 for connecting the narrow width flow channel 91 and the filtration flow channel 84 to each other.

The narrow width flow channel 91 has a part located on the +X direction side and the +Z direction side in the first flow channel plate 77 as an upstream end, a part located in a central part in the Z direction and the X direction in the first flow channel plate 77 as a downstream end, and extends while curving from the upstream end toward the downstream end. Specifically, the narrow width flow channel 91 extends from the upstream end in the −Z direction, then extends in the −X direction toward the −Z direction, and then further extends in the −Z direction. In the present embodiment, the flow channel width (the width in a direction perpendicular to the flowing direction and the Y direction) of the narrow width flow channel 91 and the flow channel depth (the depth in the Y direction) thereof are set constant throughout the whole length. It should be noted that the shape, the flow channel width, and the flow channel depth of the narrow width flow channel 91 can arbitrarily be changed.

As shown in FIG. 9, the connecting flow channel 92 is formed to have a triangular shape having the flow channel width gradually increasing toward the −Z direction in the front view viewed from the +Y direction. The connecting flow channel 92 is communicated with the downstream end of the narrow width flow channel 91 in the +Z direction end part. In the present embodiment, the flow channel width in the upstream end (the +Z direction end part) of the connecting flow channel 92 is made equivalent to the flow channel width in the downstream end of the narrow width flow channel 91.

Figure 10:
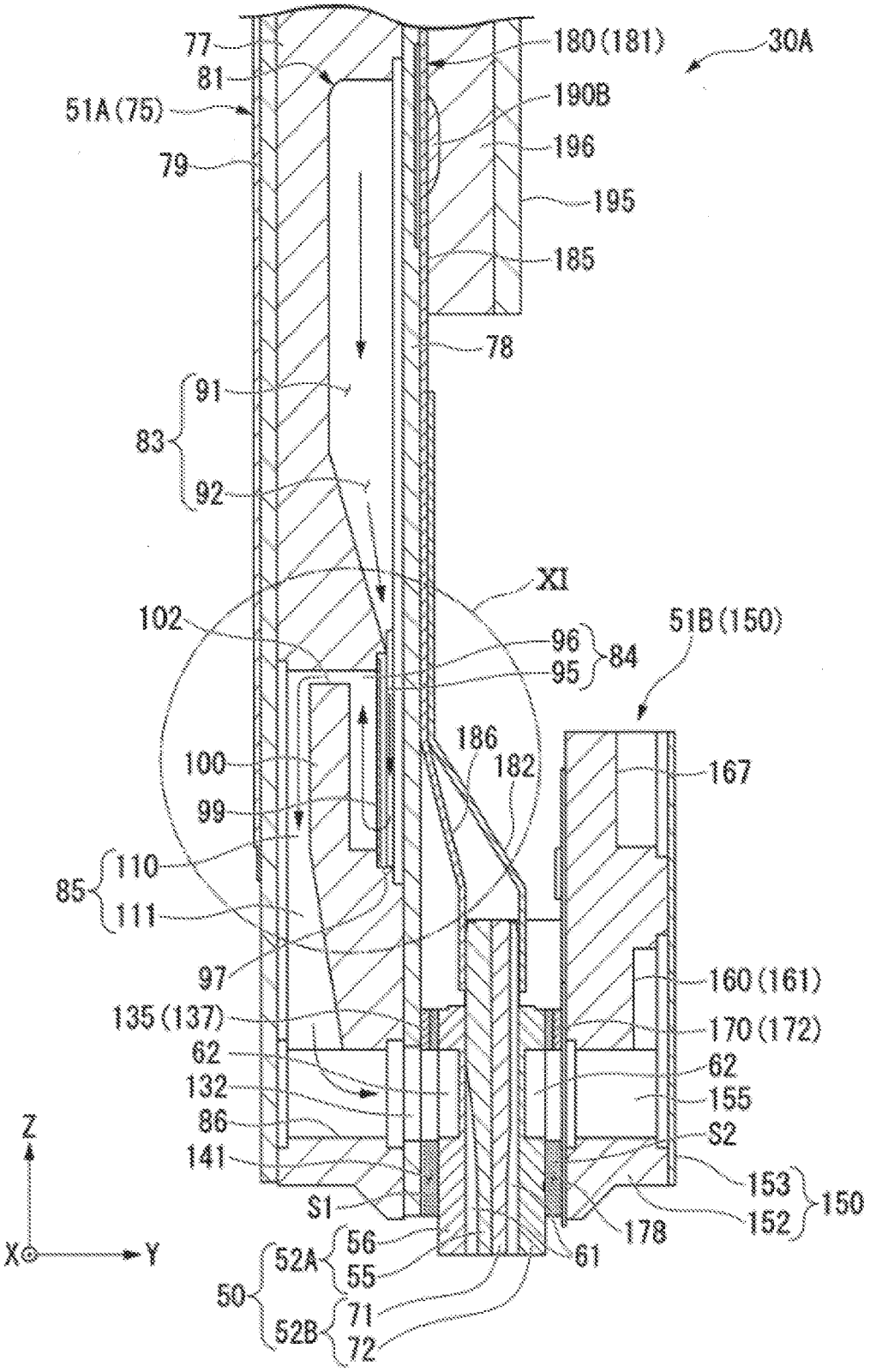
FIG. 10 is a cross-sectional view of the first jet module corresponding to the line X-X shown in FIG. 8.

FIG. 10 is a cross-sectional view of the first jet module 30A corresponding to the line X-X shown in FIG. 8.

As shown in FIG. 10, the flow channel depth of the connecting flow channel 92 gradually decreases toward the −Z direction in the cross-sectional view viewed from the +X direction. In other words, the connecting flow channel 92 of the present embodiment has the flow channel width increasing in a direction from the upstream side toward the downstream side, and has the flow channel depth decreasing in the direction from the upstream side toward the downstream side. In the present embodiment, the flow channel depth in the upstream end of the connecting flow channel 92 is made equivalent to the flow channel depth in the downstream end of the narrow width flow channel 91.

It is preferable for the flow channel cross-sectional area (the cross-sectional area in the X-Y plane) in the downstream end (the −Z direction end part) in the connecting flow channel 92 to be smaller than the flow channel cross-sectional area in the upstream end. It should be noted that the flow channel width, the flow channel depth and the flow channel cross-sectional area of the connecting flow channel 92 can arbitrarily be changed.

It should be noted that in the present embodiment, there is described the configuration in which the flow channel width and the flow channel depth vary continuously (linearly), but the invention is not limited only to this configuration. Specifically, the connecting flow channel 92 can also be formed to have, for example, a stepped shape or a curved shape providing the connecting flow channel 92 has a configuration in which the flow channel width and the flow channel depth gradually vary in a direction toward the downstream side. Further, it is also possible to adopt a configuration in which two or more straight lines different in tilt from each other are connected to one another.

Figure 11:
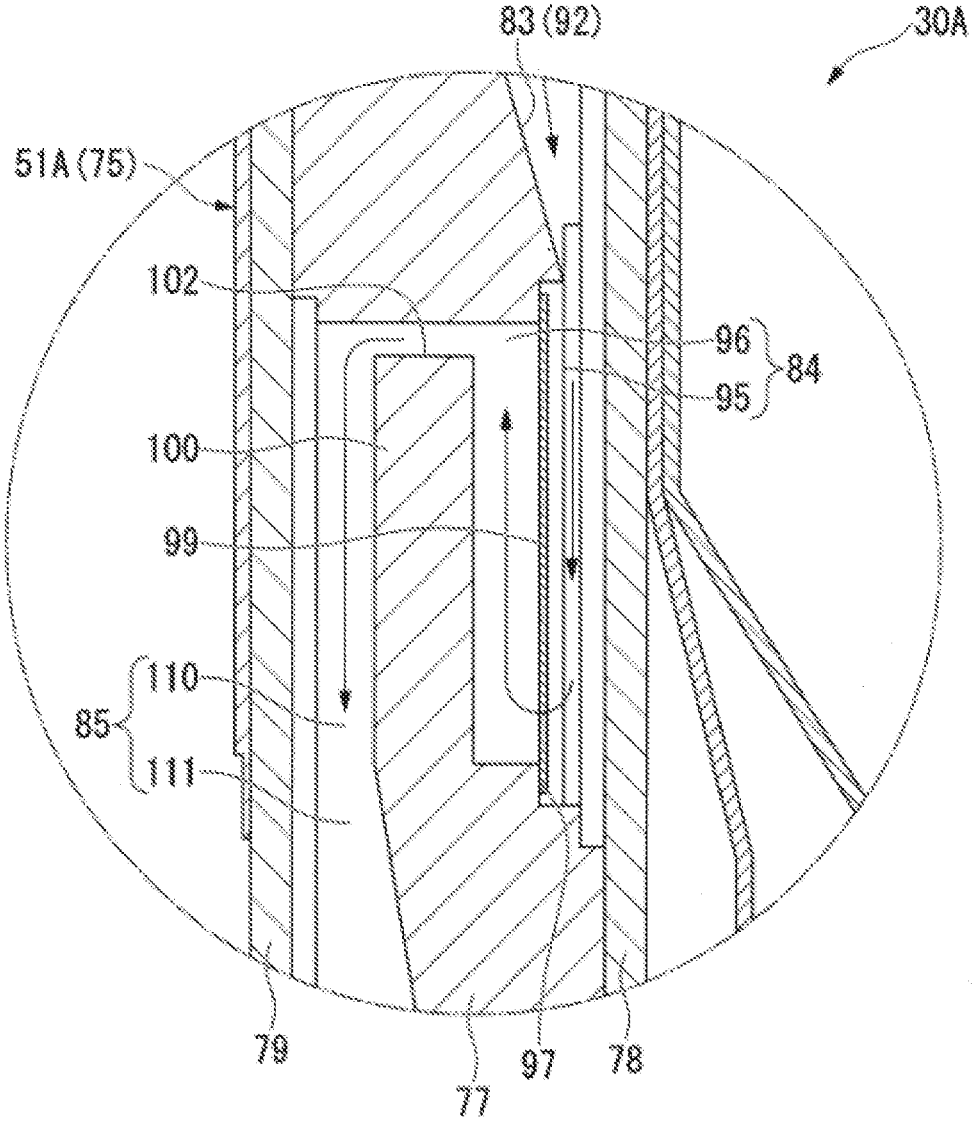
FIG. 11 is an enlarged view of the XI part in FIG. 10.

FIG. 11 is an enlarged view of the XI part in FIG. 10.

As shown in FIG. 9 and FIG. 11, the filtration flow channel 84 is communicated with the downstream end in the connecting flow channel 92 in the Z direction, and at the same time, makes the ink inflowing from the connecting flow channel 92 flow toward the −Y direction. Specifically, the filtration flow channel 84 has a filter inlet flow channel 95 located on the +Y direction side, and a filter outlet flow channel 96 continued in the −Y direction from the filter inlet flow channel 95.

The filter inlet flow channel 95 is communicated with the connecting flow channel 92 in the +Z direction end part (an upper end part in the gravitational direction). The width in the X direction in the filter inlet flow channel 95 is made equivalent to the width in the X direction in the downstream end of the connecting flow channel 92.

The area (the flow channel cross-sectional area) in the front view viewed from the Y direction of the filter outlet flow channel 96 is made one size smaller compared to that of the filter inlet flow channel 95. In other words, in the boundary part between the filter inlet flow channel 95 and the filter outlet flow channel 96, there is formed a stepped surface 97 facing to the +Y direction. The stepped surface 97 is formed to have a frame-like shape extending along the outer peripheral edge of the filter inlet flow channel 95.

In the filter inlet flow channel 95, there is disposed a main filter 99 for separating the filtration flow channel 84 into the filter inlet flow channel 95 and the filter outlet flow channel 96 in the Y direction. The main filter 99 is a mesh sheet formed to have a size equivalent to the filter inlet flow channel 95 in the planar-view outer shape viewed from the Y direction. The outer peripheral part of the main filter 99 is bonded to the stepped surface 97 described above from the +Y direction. The ink passes through the main filter 99 in the process of flowing from the filter inlet flow channel 95 to the filter outlet flow channel 96. Thus, foreign matters and bubbles included in the ink are captured by the main filter 99.

As shown in FIG. 11, an inner surface of the filter outlet flow channel 96 is provided with a reservoir wall part 100 for separating the filter outlet flow channel 96 and the downstream flow channel 85 in the Y direction. The reservoir wall part 100 is erected in the +Z direction from the −Z direction inner side surface located on the −Z direction side (the lower side in the gravitational direction) out of the inner surfaces of the filter outlet flow channel 96, and at the same time, formed throughout the entire length in the X direction of the filter outlet flow channel 96.

In the +Z direction end part in the reservoir wall part 100, there is formed a communication flow channel 102 penetrating the reservoir wall part 100 in the Y direction. The communication flow channel 102 is continuously formed throughout the entire length in the X direction in the reservoir wall part 100 (the filter outlet flow channel 96). In the present embodiment, the +Z direction inner side surface located on the +Z direction side out of the inner surfaces of the communication flow channel 102 is made coplanar with the +Z direction inner side surface located on the +Z direction side out of the inner surfaces of the filter outlet flow channel 96. In other words, the communication flow channel 102 opens in the uppermost end part of the filter outlet flow channel 96. It should be noted that the +Z direction inner side surfaces in the communication flow channel 102 and the filter outlet flow channel 96 are not limited to the case of being coplanar with each other.

It is preferable for the flow channel cross-sectional area (the area in the X-Z plane) in the upstream end of the communication flow channel 102 to be made smaller than the minimum flow channel cross-sectional area (the cross-sectional area in the X-Y plane) of the filter inlet flow channel 95 described above. It should be noted that it is also possible for the flow channel cross-sectional area of the communication flow channel 102 to be equivalent to or larger than the minimum flow channel cross-sectional area of the filter inlet flow channel 95. It should be noted that in the present embodiment, there is described the case in which the minimum flow channel cross-sectional area of the filter inlet flow channel 95 is set to the upstream end (the boundary part with the connecting flow channel 92) of the filter inlet flow channel 95, but the invention is not limited only to this configuration. In other words, the minimum flow channel cross-sectional area of the filter inlet flow channel 95 can be set to an arbitrary position in the filter inlet flow channel 95.

Figure 12:
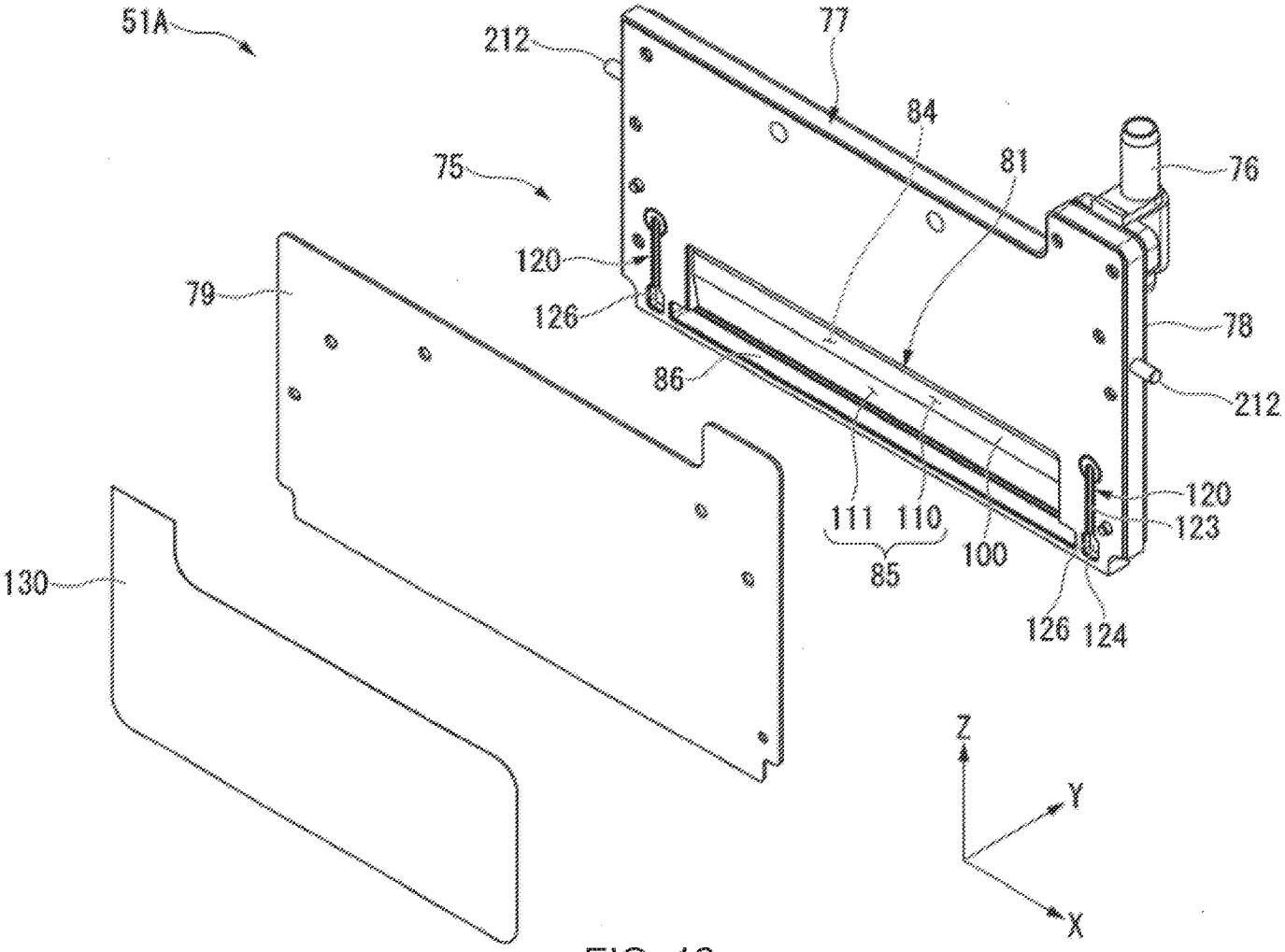
FIG. 12 is an exploded perspective view of the first flow channel member according to the embodiment developed in a −Y direction from the first flow channel plate.

FIG. 12 is an exploded perspective view of the first flow channel member 51A developed in the −Y direction from the first flow channel plate 77.

As shown in FIG. 10 and FIG. 12, the downstream flow channel 85 opens in the −Y direction in the first flow channel plate 77. Specifically, the downstream flow channel 85 has a straight part 110, and an enlarged part 111 continued on the downstream side of the straight part 110.

The straight part 110 is opposed to the filter outlet flow channel 96 in the Y direction across the reservoir wall part 100. The straight part 110 is formed to have the flow channel width in the X direction equivalent to that of the filter outlet flow channel 96, and at the same time, formed to have the flow channel depth in the Y direction constant throughout the entire length in the Z direction. The straight part 110 is communicated with the filter outlet flow channel 96 in the end part on the +Z direction side through the communication flow channel 102. It should be noted that the flow channel width and the flow channel depth of the straight part 110 can arbitrarily be changed.

The enlarged part 111 extends from the −Z direction end part of the straight part 110 toward the −Z direction. The enlarged part 111 is formed to have the flow channel width in the X direction equivalent to that of the straight part 110. The flow channel depth in the Y direction of the enlarged part 111 gradually increases in a direction toward the −Z direction. In other words, the flow channel cross-sectional area (the cross-sectional area in a direction perpendicular to the Z direction) of the enlarged part 111 gradually increases in a direction toward the downstream side (the −Z direction).

The supply flow channel 86 penetrates the first flow channel plate 77 in the Y direction in the −Z direction end part of the first flow channel plate 77. The flow channel width in the X direction in the supply flow channel 86 is made wider than that of the enlarged part 111. In the present embodiment, the flow channel width of the supply flow channel 86 is set equivalent to that of the common ink chamber 62.

The upstream end (the −Y direction end part) in the supply flow channel 86 is communicated with the downstream end (the −Z direction end part) of the enlarged part 111. Meanwhile, the downstream end in the supply flow channel 86 opens in the +Y direction in the first flow channel plate 77.

As shown in FIG. 9, the first flow channel plate 77 is provided with first bubble discharge flow channels 120 communicated with the first ink flow channel 81. The first bubble discharge flow channels 120 are formed on both sides in the X direction with respect to the filtration flow channel 84 so as to form a pair. Specifically, the first bubble discharge flow channels 120 are formed line symmetrically about a symmetry axis extending in the Z direction through the center in the X direction of the first flow channel member 51A. Therefore, in the following description, the first bubble discharge flow channel 120 located on the +X direction side with respect to the first ink flow channel 81 is described. It should be noted that the first bubble discharge flow channels 120 are not limited to the pair.

As shown in FIG. 9 and FIG. 12, the first bubble discharge flow channels 120 each have a guide part 121, a first penetration part 122, a discharge part 123, and a second penetration part 124.

The guide part 121 opens in the +Y direction in the first flow channel plate 77. The guide part 121 is continued in the +X direction from the connecting flow channel 92 and the filter inlet flow channel 95 described above. Specifically, the guide part 121 is formed to have a tapered shape gradually decreasing in the width in the Z direction in a direction toward the +X direction. Specifically, out of the inner surfaces of the guide part 121, the +Z direction inner side surface located on the +Z direction side extends linearly along the X direction. It should be noted that +Z direction inner side surface can extend obliquely toward the +Z direction or the −Z direction in a direction toward the +X direction.

Out of the inner surfaces of the guide part 121, the −Z direction inner side surface located on the −Z direction side is formed as a tilted surface extending in the +Z direction in a direction toward the +X direction. It should be noted that the depth in the Y direction in the guide part 121 is made constant throughout the entire length of the guide part 121. It should be noted that the depth of the guide part 121 can also gradually decrease in a direction, for example, toward the +X direction.

The first penetration part 122 is communicated with the guide part 121 in a top part (an intersection part between the +Z direction inner side surface and the −Z direction inner side surface) of the guide part 121. The first penetration part 122 penetrates the first flow channel plate 77 in the Y direction. In the present embodiment, the first penetration part 122 is disposed on the +Z direction side and the +X direction side of the filtration flow channel 84. It should be noted that it is preferable for the first penetration part 122 to satisfy either one of the following conditions, namely the condition that the first penetration part 122 is disposed on the +Z direction side of the filtration flow channel 84, and the condition that the first penetration part 122 is disposed on the +X direction side of the filtration flow channel 84. It should be noted that the positions in the Z direction and the X direction of the first penetration part 122 can arbitrarily be changed.

As shown in FIG. 12, the discharge part 123 opens in the −Y direction in the first flow channel plate 77. The discharge part 123 extends in the Z direction. The +Z direction end part in the discharge part 123 is communicated with the first penetration part 122 described above.

The second penetration part 124 is communicated with the −Z direction end part of the discharge part 123. The second penetration part 124 penetrates the first flow channel plate 77 in the Y direction. In the boundary part between the second penetration part 124 and the discharge part 123, there is disposed a sub-filter 126.

The rear cover 79 is formed to have a rectangular plate shape which has an equivalent outer shape to that of the first flow channel plate 77 in the front view viewed from the Y direction, and is thinner in thickness in the Y direction than the first flow channel plate 77. The rear cover 79 is fixed to a surface facing to the −Y direction out of the surfaces of the first flow channel plate 77. In other words, the rear cover 79 closes the first ink flow channel 81 (the downstream flow channel 85 and the supply flow channel 86) and the first bubble discharge flow channel 120 (the penetration parts 122, 124 and the discharge part 123) from the −Y direction. It should be noted that in the present embodiment, the rear cover 79 is formed of a metal material (e.g., stainless steel) excellent in thermal conductivity.

On the surface facing to the −Y direction in the rear cover 79, there is disposed a heater 130. The heater 130 heats the inside of the first ink flow channel 81 through the rear cover 79 to thereby keep (perform heat retention) the ink flowing through the first ink flow channel 81 within a predetermined temperature range.

As shown in FIG. 8, the front cover 78 has a rectangular plate shape formed to have the same shape and the same size as those of the rear cover 79. Specifically, the front cover 78 is made thinner in thickness in the Y direction than the first flow channel plate 77. The front cover 78 is fixed to a surface facing to the +Y direction out of the surfaces of the first flow channel plate 77. In other words, the front cover 78 closes the first ink flow channel 81 (the upstream flow channel 83 and the filtration flow channel 84) and the first bubble discharge flow channel 120 (the guide part 121, and the penetration part 122) from the +Y direction.

In the front cover 78, at a position overlapping the supply flow channel 86 viewed from the Y direction, there is formed a communication opening 132 for opening the supply flow channel 86. The communication opening 132 has an equivalent shape to the supply flow channel 86 in the front view viewed from the Y direction, and penetrates the front cover 78 in the Y direction.

In the front cover 78, at a position overlapping the upstream end (the +Z direction end part) of the upstream flow channel 83 viewed from the Y direction, there is formed an inflow opening 133 for opening the upstream flow channel 83. The inflow opening 133 penetrates the front cover 78 in the Y direction.

In the front cover 78, at positions overlapping the second penetration parts 124 viewed from the Y direction, there are formed discharge openings 134 for opening the respective second penetration parts 124. The discharge openings 134 each penetrate the front cover 78 in the Y direction.

In the present embodiment, there is described the case in which the first ink flow channel 81 having a groove-like shape is provided only to the first flow channel plate 77, but the invention is not limited only to this configuration, and it is sufficient to provide the ink flow channel to at least either one of the first flow channel plate 77, and the front cover 78 and the rear cover 79. In this case, it is also possible to provide, for example, the groove part to each of the first flow channel plate 77, and the front cover 78 and the rear cover 79, and then overlap the groove parts with each other to form the ink flow channel.

The inflow port 76 is formed to have a cylindrical shape extending in the Z direction. The inflow port 76 is fixed to the +Z direction end part in the front cover 78. The inside of the inflow port 76 is communicated with the inside of the first ink flow channel 81 through the inflow opening 133 described above.

(First Insulation Sheet)

As shown in FIG. 8, on the surface facing to the +Y direction in the front cover 78, there is disposed a first insulation sheet 135. The first insulation sheet 135 is formed to have a U shape opening in the −Z direction in the front view viewed from the Y direction. The first insulation sheet 135 surrounds the periphery of the communication opening 132 in the front cover 78. Specifically, the first insulation sheet 135 has a pair of outside pedestal parts 136 located on both sides in the X direction with respect to the communication opening 132, and a bridge part 137 for connecting the +Z direction end parts of the respective outside pedestal parts 136 to each other. It should be noted that in the present embodiment, polyimide, for example, is preferably used as the first insulation sheet 135. It should be noted that the material of the first insulation sheet 135 can arbitrarily be changed providing the material is formed of a material (e.g., a resin material or a rubber material) which has an insulating property and ink resistance (elution resistance) and is relatively soft.

In each of the outside pedestal parts 136, at a position overlapping the discharge opening 134 viewed from the Y direction, there is formed an exposure opening 140 for exposing the discharge opening 134. The exposure openings 140 respectively penetrate the outside pedestal parts 136 in the Y direction.

In each of the outside pedestal parts 136, in a part located on the +Z direction side of the exposure opening 140, there is formed a positioning hole 142 penetrating the outside pedestal part 136 in the Y direction. The positioning holes 142 each house an engaging pin 143 protruding toward the +Y direction from the first flow channel member 51A. It should be noted that the positioning holes 142 can be provided to the bridge part 137.

The bridge part 137 is located on the +Z direction side with respect to the communication opening 132. In other words, in the front cover 78, a part located on the −Z direction side with respect to the communication opening 132 forms a blank area 141 where the first insulation sheet 135 is not located. It should be noted that it is sufficient for the first insulation sheet 135 to have only the outside pedestal parts 136 in at least the non-ejection area Q2.

As shown in FIG. 10, the first head chip 52A described above is fixed to the front cover 78 and the first insulation sheet 135 in the state in which the obverse surface of the first cover plate 56 faces to the −Y direction. Specifically, in the obverse surface of the first cover plate 56, a part opposed to the first insulation sheet 135 is fixed to the first insulation sheet 135 via an adhesive S1. In contrast, in the obverse surface of the first cover plate 56, a part opposed to the blank area 141 is fixed directly to the front cover 78 via the adhesive S1.

In the state in which the first head chip 52A is fixed to the first flow channel member 51A, the drive walls 61 (the ejection area Q1 shown in FIG. 6) are opposed to the blank area 141 in the Y direction. In other words, in the present embodiment, it is arranged that only the adhesive S1 intervenes (the first insulation sheet 135 does not intervene)

between the drive walls 61 and the front cover 78. In this case, the adhesive S1 surrounds the periphery of the common ink chamber 62 and the communication opening 132, and seals an area between the first head chip 52A and the first flow channel member 51A. It should be noted that as the adhesive S1 used in the present embodiment, there is used a material (e.g., silicone series) or the like which has an insulating property, and is relatively soft (softer than the first insulation sheet 135).

In the state in which the first head chip 52A is fixed to the first flow channel member 51A, the common ink chamber 62 of the first cover plate 56 is communicated with the supply flow channel 86 through the communication opening 132. Meanwhile, as shown in FIG. 8, the first bubble-vent holes 65A (see FIG. 7) of the first head chip 52A are communicated with the first bubble discharge flow channels 120 (the second penetration parts 124) through the exposure openings and the discharge openings 134, respectively.

(Second Flow Channel Member)

As shown in FIG. 5, the second flow channel member 51B has a second manifold 150 and second biasing members 151.

The second manifold 150 is formed to have a plate-like shape the thickness direction of which is the Y direction as a whole, and the length in the Z direction of which is shorter than the first manifold 75. As shown in FIG. 3, the −Z direction end part of the second manifold 150 is inserted into the first module housing section 44A described above, and thus, the second manifold 150 is held by the base member 38 in the state of rising in the +Z direction.

As shown in FIG. 5, the second manifold 150 has a second flow channel plate 152, and a flow channel cover 153.

Similarly to the first flow channel plate 77, the second flow channel plate 152 is formed of a metal material (e.g., aluminum) or the like. The second flow channel plate 152 is provided with a second ink flow channel 155 through which the ink flows toward the second head chip 52B.

Figure 13:
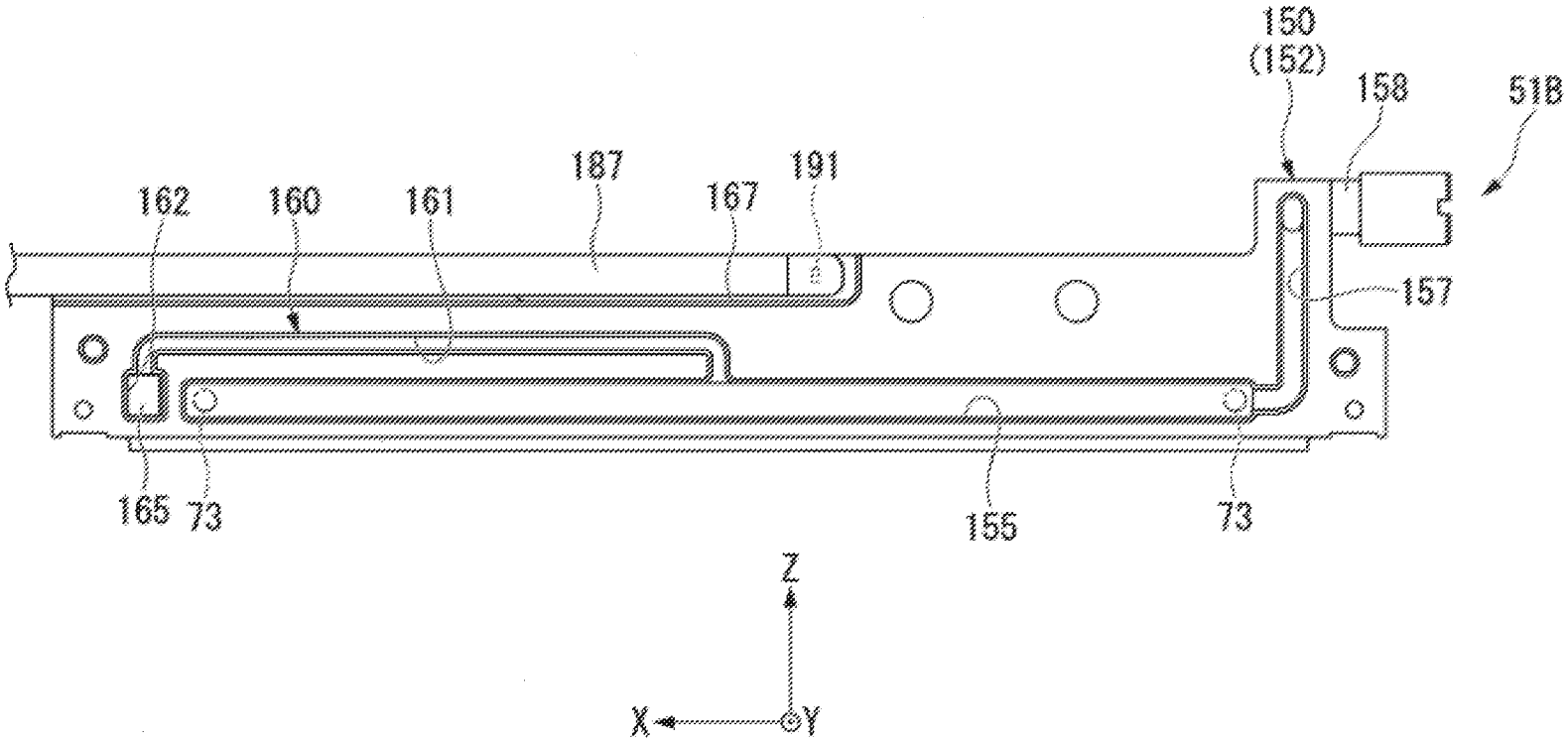
FIG. 13 is a front view of a second flow channel plate according to the embodiment viewed from the +Y direction.

FIG. 13 is a front view of the second flow channel plate 152 viewed from the +Y direction.

As shown in FIG. 13, the second flow channel 155 penetrates the second flow channel plate 152 in the Y direction, and at the same time, extends like a belt in the X direction. The second ink flow channel 155 is formed so that the front view outer shape viewed from the Y direction has an equivalent shape to the shape of the common ink chamber 62. Therefore, the communication holes 73 of the ejection section 50 are opposed to the second ink flow channel 155 in the Y direction in the both end parts in the X direction in the second ink flow channel 155. It should be noted that in the present embodiment, it is preferable for the total capacity of the second ink flow channel 155 and the common ink chamber 62 of the second head chip 52B to be set equivalent to the total capacity of the supply flow channel 86 described above and the common ink chamber 62 of the first head chip 52A.

The reference numeral 157 in FIG. 13 denotes a cleaning flow channel communicated with the second ink flow channel 155. In a maintenance process or the like, a cleaning liquid is sucked from a nozzle hole 240 described later, then flows through the ejection section 50, the second ink flow channel 155, and so on, and then inflows into the cleaning flow channel 157. The cleaning liquid having flown into the cleaning flow channel 157 is sucked through a cleaning port 158.

The second flow channel plate 152 is provided with a second bubble discharge flow channel 160 communicated with the second ink flow channel 155. The second bubble discharge flow channel 160 has a discharge part 161 and a penetration part 162.

The discharge part 161 opens in the +Y direction in the second flow channel plate 152. The discharge part 161 extends in the X direction in a part located on the +Z direction side of the second ink flow channel 155 in the second flow channel plate 152. An upstream end of the discharge part 161 opens in the central part in the X direction of the +Z direction inner side surface located on the +Z direction side (upper side in the gravitational direction) in the inner surface of the second ink flow channel 155. In other words, the distances in the X direction between the pair of communication holes 73 described above and the upstream end of the discharge part 161 are set equivalent to each other. It should be noted that the distances in the X direction between the pair of communication holes 73 and the upstream end of the discharge part 161 can arbitrarily be changed. Further, the number and the positions of the communication holes 73 can arbitrarily be changed.

The downstream end of the discharge part 161 is communicated with the penetration part 162 in a part located on the +X direction side with respect to the second ink flow channel 155. It should be noted that in the present embodiment, there is described the configuration in which the second bubble discharge flow channel 160 is disposed on the +Z direction side with respect to the second ink flow channel 155, but the invention is not limited only to this configuration.

The penetration part 162 penetrates the second flow channel plate 152 in the Y direction. Inside the penetration part 162, there is disposed a sub-filter 165.

In the second flow channel plate 152, in a part located on the +Z direction side of the second bubble discharge flow channel 160, there is formed a sensor housing part 167. The sensor housing part 167 opens in the +Y direction in the second flow channel plate 152, and at the same time, extends in the X direction.

As shown in FIG. 5, the flow channel cover 153 is formed to have a rectangular plate shape which has an equivalent outer shape to that of the second flow channel plate 152 in the front view viewed from the Y direction, and is thinner in thickness in the Y direction than the second flow channel plate 152. The flow channel cover 153 closes the second ink flow channel 155, the second bubble discharge flow channel 160, and the sensor housing part 167 from the +Y direction. It should be noted that the flow channel cover 153 is formed of a metal material (e.g., stainless steel) excellent in thermal conductivity.

The second biasing members 151 are disposed in the both end parts in the X direction in the second flow channel plate 152 forming a pair. Each of the second biasing members 151 is made to be shaped like a plate spring with the free end disposed on the +Y direction side of the second flow channel plate 152. As shown in FIG. 3, the second biasing members 151 intervene between a first long side part 45*c* out of long side parts 45*c*, 45*d* opposed to each other in the Y direction in the base main body part 41 and the second manifold 150 in the state in which the second flow channel member 51B is inserted into the first module housing section 44A. In other words, the second biasing members 151 bias the jet module 30A toward the −Y direction.

(Second Insulation Sheet)

As shown in FIG. 5, on the surface facing to the −Y direction in the second flow channel plate 152, there is disposed a second insulation sheet 170. Similarly to the first insulation sheet 135 described above, the second insulation sheet 170 has outside pedestal parts 171 and a bridge part 172.

Out of the outside pedestal parts 171, in the outside pedestal part 171 located on the +X direction side, at a position overlapping the penetration part 162 viewed from the Y direction, there is formed an exposure opening 175 for exposing the penetration part 162. The exposure opening 175 penetrates the outside pedestal part 171 in the Y direction.

The bridge part 172 is located on the +Z direction side with respect to the second ink flow channel 155. In other words, in the second flow channel plate 152, a part located on the −Z direction side with respect to the second ink flow channel 155 forms a blank area 178 (see FIG. 10) where the second insulation sheet 170 is not located.

In the bridge part 172, in the both end parts in the X direction, there are formed positioning holes 173 penetrating the bridge part 172 in the Y direction. The positioning holes 173 each house an engaging pin (not shown) protruding toward the −Y direction from the second flow channel member 51B. It should be noted that the positioning holes 173 can be provided to the outside pedestal parts 171.

As shown in FIG. 10, the second head chip 52B described above is fixed to the second flow channel plate 152 and the second insulation sheet 170 in the state in which the obverse surface of the second cover plate 72 faces to the +Y direction. Specifically, in the obverse surface of the second cover plate 72, a part opposed to the second insulation sheet 170 is fixed to the second insulation sheet 170 via an adhesive S2. In contrast, in the obverse surface of the second cover plate 72, a part opposed to the blank area 178 is fixed directly to the second flow channel plate 152 via the adhesive S2. In the state in which the second head chip 52B is fixed to the second flow channel member 51B, the drive walls 61 (the ejection area Q1 shown in FIG. 6) are opposed to the blank area 178 in the Y direction. In this case, the adhesive S2 surrounds the periphery of the common ink chamber 62 and the second ink flow channel 155, and seals an area between the second head chip 52B and the second flow channel member 51B. It should be noted that substantially the same materials are used respectively for the adhesives S1, S2.

In the present embodiment, there is described the configuration in which the insulation sheets 135, 170 are made to intervene between the head chips 52A, 52B and the flow channel members 51A, 51B, respectively, but it is sufficient that the first insulation sheet 135 intervenes at least between the first head chip 52A and the first flow channel member 51A.

In the state in which the second head chip 52B is fixed to the second flow channel member 51B, the common ink chamber 62 of the second cover plate 72 is communicated with the second ink flow channel 155. The second bubble-vent hole 65B of the second head chip 52B is communicated with the second bubble discharge flow channel 160 (the penetration part 162) through the exposure opening 175.

As described above, in the jet module 30A according to the present embodiment, the first flow channel member 51A and the second flow channel member 51B are opposed to each other in the Y direction, and at the same time, the ejection section 50 having the two head chips 52A, 52B is held between the flow channel members 51A, 51B.

(FPC Unit)

As shown in FIG. 5, an FPC unit 180 is supported by the front cover 78 of the first manifold 75. The FPC unit 180 is provided with a drive board 181 and a wiring board 182. The drive board 181 and the wiring board 182 are each a flexible printed board, and are each formed of a base film provided with wiring patterns formed thereon.

The drive board 181 has a mounting part 185, a chip connection part 186, a sensor connection part 187, and an extraction part 188. It should be noted that in the drive board 181, it is also possible to use a rigid board or the like as the mounting part 185.

The mounting part 185 is supported by the front cover 78. On the mounting part 185, there is mounted, for example, a plurality of drivers 190A, 190B. The drivers 190A, 190B correspond to first drivers 190A for driving the first head chip 52A, and second drivers 190B for driving the second head chip 52B. The drivers 190A, 190B are arranged linearly in the X direction. It should be noted that although in the present embodiment, there is described the configuration in which the first drivers 190A and the second drivers 190B are mounted on the single drive board 181 in a lump, the invention is not limited only to this configuration, and it is also possible to provide the drive boards corresponding respectively to the drivers.

As shown in FIG. 10, the chip connection part 186 extends from the mounting part 185 in the −Z direction. The −Z direction end part of the chip connection part 186 is fixed to the +Z direction end part of the first actuator plate 55 with pressure bonding or the like. Thus, the first drivers 190A and the drive electrodes 59 of the first head chip 52A are electrically connected to each other via the chip connection part 186.

As shown in FIG. 5 and FIG. 13, the sensor connection part 187 extends from the mounting part 185 in the +X direction. In the tip part of the sensor connection part 187, there is mounted a temperature sensor 191 (e.g., a thermistor). The sensor connection part 187 is housed in the sensor housing part 167. Specifically, the temperature sensor 191 detects ink temperature in the ejection section 50 via the second flow channel plate 152.

The extraction part 188 extends from the mounting part 185 in the +Z direction. The extraction part 188 is connected to an interface 192 (see FIG. 3). The interface 192 is for, for example, supplying the FPC unit 180 with electrical power supplied from the outside of the ink jet head 5A, or performing transmission and reception of a control signal.

As shown in FIG. 5 and FIG. 10, the wiring board 182 connects the mounting part 185 and the second head chip 52B to each other. Specifically, out of the wiring board 182, the +Z direction end part is connected to the mounting part 185, and the −Z direction end part is fixed to the +Z direction end part of the second actuator plate 71 with pressure bonding or the like. Thus, the second drivers 190B and the drive electrodes 59 of the second head chip 52B are electrically connected to each other via the wiring board 182.

As shown in FIG. 3 and FIG. 5, in the first flow channel member 51A, at positions overlapping the drivers 190A, 190B described above viewed from the Y direction, there is disposed a heatsink 195. The heatsink 195 is formed so as to straddle the drive board 181 in the X direction. The heatsink 195 covers the drivers 190A, 190B with a heat-transfer sheet 196 sandwiched therebetween. The both end parts in the X direction of the heatsink 195 are fixed to the first flow channel member 51A on the outer side of the drive board 181. It should be noted that the heatsink 195 and the heat-transfer sheet 196 are each formed of a material excellent in thermal conductivity. In the present embodiment, the heatsink 195 is formed of, for example, aluminum, and the heat-transfer sheet 196 is formed of, for example, silicone resin.

As shown in FIG. 3 and FIG. 4, the first jet module 30A described above is inserted into the first module housing section 44A in the state in which the first flow channel member 51A faces to the −Y direction, and the second flow channel member 51B faces to the +Y direction. On this occasion, the first jet module 30A is held by the base member 38 in the state in which the first biasing member 48 intervenes between the second flow channel member 51B and the first short side part 45*a*, and the second biasing members 151 intervene between the second flow channel member 51B and the first long side part 45*c*. Therefore, the first jet module 30A is held by the base member 38 in the state of being biased in the −X direction (the direction toward the second sort side part 45*b*) by the first biasing member 48, and being biased in the −Y direction (the direction toward the partition part 46) by the second biasing members 151. On this occasion, it is preferable for the −Z direction end surface of the ejection section 50 to be disposed on the same plane as the −Z direction end surface of the base member 38 (the base main body part 41), or disposed on the −Z direction side of the −Z direction end surface of the base member 38.

The second jet module 30B is inserted into the second module housing section 44B in the state in which the first flow channel member 51A faces to the +Y direction, and the second flow channel member 51B faces to the −Y direction. In other words, the first flow channel member 51A of the second jet module 30B is opposed to the first flow channel member 51A of the first jet module 30A in the Y direction. It should be noted that the jet modules 30A, 30B are fixed to the corresponding module housing sections 44A, 44B with an adhesive.

(Stay Unit)

As shown in FIG. 2, the base member 38 is provided with a stay unit 200 for supporting components mounted to the base member 38. The stay unit 200 rises in the +Z direction from the base member 38, and at the same time collectively surrounds the periphery of the jet modules 30A, 30B.

In the stay unit 200, module holding mechanisms 210 intervene between the X direction stays (a first stay 201 and a second stay 202) located on both sides in the X direction, and the jet modules 30A, 30B, respectively. It should be noted that since the module holding mechanisms 210 have substantially the same configurations, the module holding mechanism 210 intervening between the first stay 201 and the first jet module 30A will be described as an example in the following description.

The first stay 201 is located on the +X direction side with respect to the jet modules 30A, 30B. The first stay 201 rises in the +Z direction from the base member 38 in the state in which the −Z direction end part is inserted into the module housing sections 44A, 44B. It should be noted that the first stay 201 is assembled and then attached to the base member 38 after assembling the jet modules 30A, 30B and then attaching the jet modules 30A, 30B to the base member 38.

Figure 14:
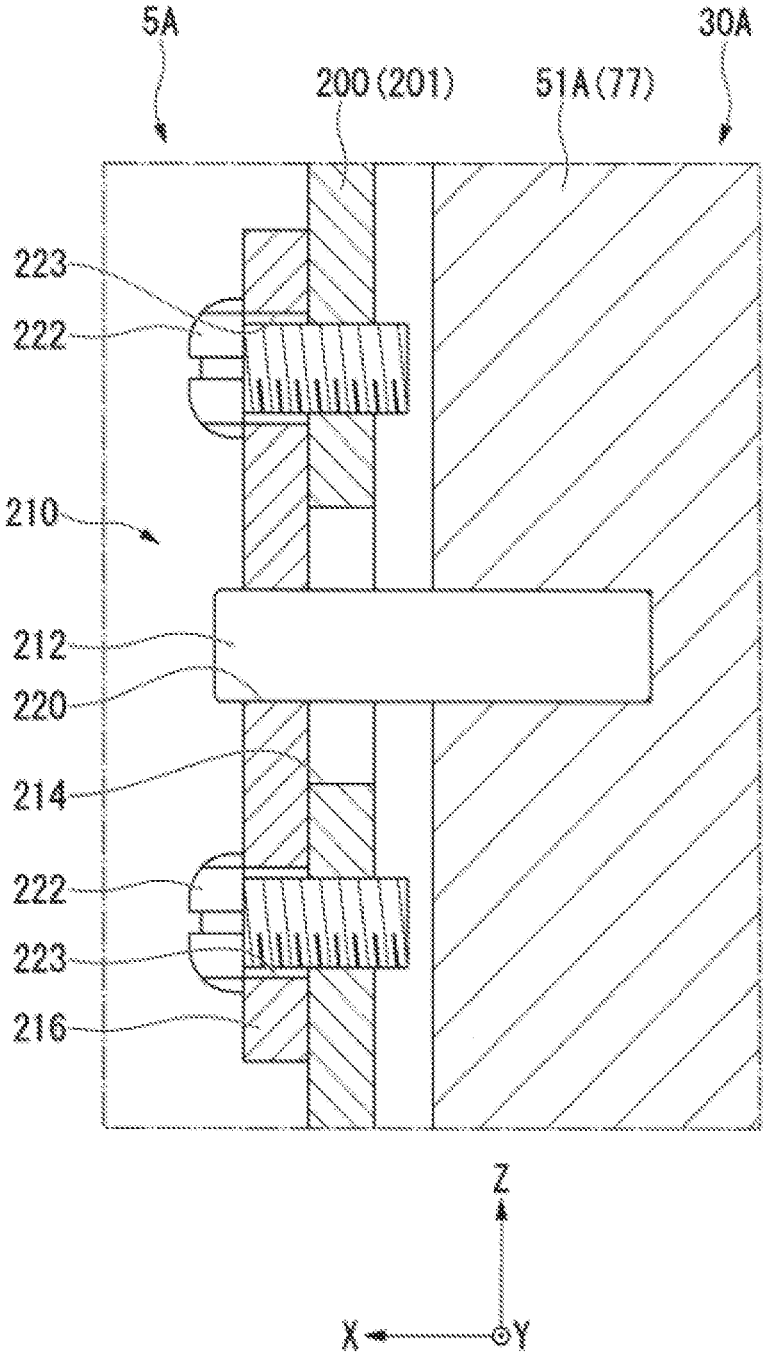
FIG. 14 is a partial cross-sectional view along the line XIV-XIV shown in FIG. 2.

FIG. 14 is a partial cross-sectional view along the line XIV-XIV shown in FIG. 2.

As shown in FIG. 3 and FIG. 14, the module holding mechanism 210 has a positioning pin 212 provided to the first flow channel member 51A, a first housing part 214 provided to the first stay 201, and a support segment 216 for connecting the positioning pin 212 and the first stay 201 to each other.

The positioning pin 212 projects in the +X direction from the first flow channel plate 77. It should be noted that it is preferable for the positioning pin 212 to be disposed at a position distant in the Z direction from the base member 38. In the present embodiment, the positioning pin 212 is disposed in a part located on the +Z direction side of the central part in the Z direction in the first flow channel plate 77.

The first housing part 214 is formed by penetrating a part of the first stay 201 in the X direction, wherein the part of the first stay 201 overlaps the positioning pin 212 in the side view viewed from the X direction. The first housing part 214 is formed to have a circular shape in the side view viewed from the X direction, and at the same time, formed to have a uniform inner diameter. The inner diameter of the first housing part 214 is made larger than the outer diameter of the positioning pin 212. The positioning pin 212 described above projects in the +X direction with respect to the first stay 201 penetrating the first housing part 214.

The support segment 216 is a plate member the longitudinal direction of which is the Z direction. The support segment 216 is fixed to the first stay 201 so as to close the first housing part 214 from the +X direction. Specifically, in the support segment 216, at a position overlapping the first housing part 214 in the side view viewed from the X direction, there is formed a second housing part 220 penetrating the support segment 216 in the X direction. The second housing part 220 is formed to have a circular shape in the side view viewed from the X direction, and at the same time, formed to have a uniform inner diameter. The inner diameter of the second housing part 220 is made smaller than the inner diameter of the first housing part 214, and is made larger than the outer diameter of the positioning pin 212. The positioning pin 212 described above is inserted in the second housing part 220. Then, by the outer peripheral surface of the positioning pin 212 having contact with the inner peripheral surface of the second housing part 220, the movement of the first jet module 30A in a direction perpendicular to the X direction with respect to the first stay 201 is restricted.

It should be noted that it is possible for the positioning pin 212 to be fitted in the second housing part 220. The side view inner shape of each of the first housing part 214 and the second housing part 220 is not limited to the circular shape, but can also be a rectangular shape, or a triangular shape. Further, it is also possible for the first housing part 214 and the second housing part 220 to be different in shape from each other. In such a case as described above, the opening area of the second housing part 220 is set smaller than the opening area of the first housing part 214.

The second housing part 220 is not required to penetrate the support segment 216 providing the positioning pin 212 can be inserted.

It is also possible for the first housing part 214 and the second housing part 220 to have a configuration in which the inner diameter gradually varies.

The support segment 216 is fixed to the first stay 201 with screws 222 on the both sides in the Z direction with respect to the second housing part 220. Specifically, in the support segment 216, on the both sides in the Z direction with respect to the second housing part 220, there are formed relief holes 223. The inner diameter of each of the relief holes 223 is made larger than the outer diameter of the shaft part of the screw 222. The screw 222 is tightened to the first stay 201 through the relief hole 223. By clamping the support segment 216 in the X direction between the head of the screw 222 and the first stay 201, the support segment 216 is fixed to the first stay 201. It should be noted that the tip part of each of the screws 222 is close to the first flow channel plate 77 in the X direction.

As described above, the first jet module 30A according to the present embodiment is held by the base member 38 due to the −Z direction end part inserted into the first module housing section 44A, and the +Z direction end part is held by the module holding mechanisms 210.

(Damper)

As shown in FIG. 2, the dampers 31 are disposed on the +Z direction side of the jet modules 30A, 30B so as to correspond respectively to the jet modules 30A, 30B (corresponding to the colors of the ink). The dampers 31 are disposed side by side in the Y direction. It should be noted that the dampers 31 have equivalent configurations except the colors of the ink supplied. Therefore, in the following description, one of the dampers 31 (the damper 31 of the first jet module 30A) will be described, and the description of the other of the dampers 31 will be omitted.

The damper 31 is fixed to the stay unit 200 described above on the +Z direction side of the first jet module 30A. The damper 31 has an entrance port 230, a pressure buffering section 231, and an exit port 232. It should be noted that it is also possible to dispose the dampers 31 separately from the inkjet head 5A.

The entrance port 230 is formed to have a cylindrical shape disposed so as to protrude in the +Z direction from the pressure buffering section 231. To the entrance port 230, there is connected the ink pipe 16 (see FIG. 1) described above. The ink in the ink tank 15 inflows into the entrance port 230 through the ink pipe 16.

The pressure buffering section 231 is formed to have a box-like shape. The pressure buffering section 231 is configured housing a movable film and so on inside. The pressure buffering section 231 is disposed between the ink tank 15 (FIG. 1) and the first jet module 30A, and absorbs the pressure variation of the ink supplied to the damper 31 through the entrance port 230.

The exit port 232 is disposed so as to protrude in the −Z direction from the pressure buffering section 231 at a position of an opposing corner to the entrance port 230. The ink discharged from the pressure buffering section 231 inflows into the exit port 232. To the exit port 232, there is connected the inflow port 76 of the first jet module 30A.

In a part located between the dampers 31 opposed in the Y direction to each other, there is disposed the interface 192 described above. The interface 192 is supported by the stay unit 200.

(Nozzle Plate)

The nozzle plate 32 described above is formed of a resin material such as polyimide. The nozzle plate 32 is fixed to the −Z direction end surface of the base main body part 41 and the −Z direction end surface (parts exposed from the module housing sections 44A, 44B) of the ejection sections 50 via an adhesive or the like. The nozzle plate 32 collectively covers the ejection sections 50 of the respective jet modules 30A, 30B from the −Z direction.

As shown in FIG. 6 and FIG. 7, the nozzle plate 32 is provided with the nozzle holes 240 penetrating the nozzle plate 32 in the Z direction. The nozzle holes 240 are independently formed at positions opposed in the Z direction to the respective ejection channels 57 of the head chips 52A, 52B.

In the nozzle plate 32, at positions opposed in the Z direction to the bubble-vent holes 65A, 65B described above, there are formed discharge holes 241A, 241B penetrating the nozzle plate 32 in the Z direction. In other words, in the present embodiment, the nozzle holes 240 and the discharge holes 241A, 241B each open on the ejection surface (a surface facing to the −Z direction) of the nozzle plate 32. The discharge holes 241A, 241B of the present embodiment are first discharge holes 241A communicated with the first bubble-vent holes 65A and a second discharge hole 241B communicated with the second bubble-vent hole 65B. The inner diameter (the opening area) of the second discharge hole 241B is made smaller than the inner diameter of each of the first discharge holes 241A. It should be noted that the inner diameters of the discharge holes 241A, 241B can arbitrarily be changed. Further, the discharge holes 241A, 241B are not limited to the case of adopting the circular holes.

It should be noted that the ink in each of the nozzles 240 and the discharge holes 241A, 241B is provided with an appropriate (concave) meniscus due to the surface tension and so on acting on the inside surface of each of the nozzle holes 240 and the discharge holes 241A, 241B. Specifically, in the printer 1 according to the present embodiment, due to the water head difference between the liquid surface of the ink tank 15 and the liquid surface of the meniscus, the pressure in each of the ejection channels 57 is kept at desired negative pressure. Thus, it is arranged that the meniscus described above is maintained to prevent the ink from unexpectedly leaking.

It should be noted that the nozzle plate 32 can also be formed of a metal material (e.g., stainless steel) besides the resin material, and it is also possible to adopt a layered structure of the resin material and the metal material. In the present embodiment, there is described the configuration in which the single nozzle plate 32 collectively covers the jet modules 30A, 30B, but the invention is not limited only to this configuration. It is also possible to adopt a configuration in which the jet modules 30A, 30B are individually covered with a plurality of nozzle plates 32.

(Nozzle Guard)

As shown in FIG. 2, the nozzle guard 33 is formed by applying a press work on a plate member made of, for example, stainless steel. The nozzle guard 33 covers the base main body part 41 from the −Z direction in the state of sandwiching the nozzle plate 32 in between.

In the nozzle guard 33, at the positions opposed in the Z direction to the ejection sections 50 of the jet modules 30A, 30B, there are formed exposure holes 245 for exposing the nozzle plate 32 to the outside. The exposure holes 245 are each formed to have a slit-like shape penetrating the nozzle guard 33 in the Z direction, and at the same time, extending in the X direction. There are formed two lines of the exposure holes 245 at an interval in the Y direction so as to correspond respectively to the jet modules 30A, 30B. The nozzle holes 240 and the discharge holes 241A, 241B described above are communicated with the outside of the inkjet head 5A through the exposure holes 245. It should be noted that it is also possible to adopt a configuration in which a cap to be firmly attached to the nozzle guard 33 from the −Z direction to seal the nozzle holes 240 and the discharge holes 241A, 241B is attached to the nozzle guard 33 when filling the ink or stopping the print operation.

[Operation Method of Printer]

Then, a method of recording information on the recording target medium P using the printer 1 described above will be described.

As shown in FIG. 1, when operating the printer 1, the grit rollers 11, 13 of the conveying mechanisms 2, 3 rotate to thereby convey the recording target medium P between the grit rollers 11, 13 and the pinch rollers 12, 14 in the +X direction. Further, at the same time as this operation, the drive motor 28 rotates the pulley 26 to run the endless belt 27. Thus, the carriage 23 reciprocates in the Y direction while being guided by the guide rails 21, 22.

Meanwhile, in the inkjet heads 5A, 5B, the drive voltages are applied to the respective drive electrodes 59 (see FIG. 7) of the head chips 52A, 52B. Thus, the thickness shear deformation is caused in the drive wall 61, and thus, the pressure wave is generated in the ink filling the ejection channel 57. Due to the pressure wave, the internal pressure of the ejection channel 57 increases, and the ink is ejected through the nozzle hole 240. Further, by the ink landing on the recording target medium P, a variety of types of information are recorded on the recording target medium P.

Here, the flow of the ink in the first jet module 30A of the inkjet head 5A will be described.

As shown in FIG. 3, in the present embodiment, the ink supplied from the ink tank 15 to the inkjet head 5A passes through the damper 31, and then inflows into the first manifold 75 of the jet module 30A through the inflow port 76.

As indicated by the arrowed solid lines in FIG. 10, the ink having flown into the first manifold 75 passes through the upstream flow channel 83, and then inflows into the filter inlet flow channel 95 of the filtration flow channel 84 from the +Z direction. As indicated by the arrowed solid lines in FIG. 11, the ink having flown into the filter inlet flow channel 95 passes through the main filter 99 in the process of proceeding from the filter inlet flow channel 95 toward the filter outlet flow channel 96. Thus, foreign matters and bubbles included in the ink are captured by the main filter 99. The ink having reached the inside of the filter outlet flow channel 96 is stopped flowing in the −Y direction (toward the downstream flow channel 85) by the reservoir wall part 100. Thus, the filter outlet flow channel 96 is filled with the ink.

When the ink filling the filter outlet flow channel 96 reaches the communication flow channel 102, the ink inflows into the downstream flow channel 85 through the communication flow channel 102. The ink flows through the downstream flow channel 85 toward the −Z direction, and then flows through the supply flow channel 86 toward the +Y direction. The ink flowing through the supply flow channel 86 inflows into the common ink chamber 62 of the first head chip 52A through the communication opening 132. After inflowing into the common ink chamber 62 of the first head chip 52A, a part of the ink passes through the slit 63 to inflow into the ejection channel 57, and is then ejected through the nozzle hole 240 in the first head chip 52A.

Meanwhile, a part of the ink having flown into the common ink chamber 62 of the first head chip 52A inflows into the communication holes 73 in the both end parts in the X direction in the common ink chamber 62. Subsequently, the ink inflows into the common ink chamber 62 of the second head chip 52B through the communication holes 73. The ink having flown into the common ink chamber 62 of the second head chip 52B flows toward the inside in the X direction while filling the second ink flow channel 155. Subsequently, the ink having flown into the second head chip 52B inflows into the ejection channel 57 through the slit 63, and is then ejected through the nozzle hole 240.

Incidentally, as indicated by the arrowed dotted line in FIG. 9, in the first ink flow channel 81, the bubbles retained in the filter inlet flow channel 95 (on the upstream side of the main filter 99) are discharged outside the first jet module 30A through the first bubble discharge flow channel 120. Specifically, the bubbles captured by the main filter 99 and the bubbles retained in the filter inlet flow channel 95 are pushed out toward the both sides in the X direction in the process in which the ink flows through the filter inlet flow channel 95 toward the both sides in the X direction. Subsequently, the bubbles enter the guide parts 121, and then move through the guide parts 121 toward the outer sides in the X direction, and toward the +Z direction. Then, the bubbles move in the −Y direction through the first penetration parts 122. Subsequently, the bubbles move toward the −Z direction through the discharge parts 123, and then enter the second penetration parts 124 through the respective sub-filters 126 (see FIG. 12). The bubbles having entered the second penetration parts 124 enter the first bubble-vent holes 65A of the first head chip 52A as shown in FIG. 6, and are then discharged outside through the first discharge holes 241A of the nozzle plate 32.

Meanwhile, in the case in which bubbles are retained in the common ink chamber 62 of the second head chip 52B and the second flow channel member 51B (the second ink flow channel 155), the bubbles are discharged outside the first jet module 30A through the second bubble discharge flow channel 160. Specifically, the bubbles retained in the second ink flow channel 155 and so on reach the penetration part 162 through the discharge part 161. The bubbles having reached the penetration part 162 pass through the sub-filter 165, and then enter the second bubble-vent hole 65B of the second head chip 52B shown in FIG. 6. Subsequently, the bubbles are discharged outside through the second discharge hole 241B of the nozzle plate 32.

As described above, in the present embodiment, there is adopted the configuration in which the first ink flow channel 81 and the second ink flow channel 155 are communicated with each other through the communication holes 73 of the first head chip 52A and the second head chip 52B.

According to this configuration, it is possible to supply the ink to the two head chips 52A, 52B through the single inflow port 76. Thus, it becomes possible to reduce the size compared to the case of supplying the ink to the respective head chips 52A, 52B through separate inflow ports.

In the present embodiment, there is adopted the configuration in which the communication holes 73 are formed in the first head chip 52A and the second head chip 52B.

According to this configuration, an increase in the number of components can be suppressed compared to the case of providing the communication flow channels separately from the head chips 52A, 52B. Further, it is possible to shorten the flow channel length of the communication flow channel to thereby reduce the pressure loss in the communication flow channel.

In the present embodiment, there is adopted the configuration in which the drive board 181 is supported by the first flow channel member 51A.

According to this configuration, both of the ejection section 50 and the drive board 181 are supported by the first flow channel member 51A having the first ink flow channel 81. Therefore, it becomes possible to reduce the size (the height) in the Y direction of the inkjet heads 5A, 5B compared to the case of, for example, separately disposing the drive board 181 and the first flow channel member 51A on the both sides in the Y direction across the ejection section 50 from each other.

Further, since the ejection section 50 and the drive board 181 are supported by the first flow channel member 51A, it results that the heat generated in the ejection section 50 and the drive board 181 is radiated outside via the first flow channel member 51A. Thus, it is possible to ensure the heat radiation performance of the ejection section 50 and the drive board 181.

Further, since the ejection section 50 and the drive board 181 are supported by the first flow channel member 51A, it is also possible to heat the ink flowing through the first ink flow channel 81 using the exhaust heat generated in the ejection section 50 and the drive board 181 and then transmitted to the first flow channel member 51A. Thus, it is possible to supply the ink to the ejection section 50 at desired temperature (viscosity), and thus, excellent print characteristics can be obtained.

In the present embodiment, there is adopted the configuration in which the first drivers 190A and the second drivers 190B are mounted on the drive board 181 in a lump.

According to this configuration, it is possible to achieve simplification and miniaturization of the configuration compared to the case of providing the drive board on which the drivers are mounted for each of the head chips 52A, 52B.

In the present embodiment, there is adopted the configuration in which the temperature sensor 191 is mounted on the second flow channel member 51B.

According to this configuration, since it is possible to dispose the temperature sensor 191 at a position adjacent to the ejection section 50, the ink temperature in the ejection section 50 can accurately be detected.

In particular, since the temperature sensor 191 is installed in the second flow channel member 51B, it is possible to prevent the heat of the drive board 181 supported by the first flow channel member 51A from affecting the temperature sensor 191. Therefore, the ink temperature can more accurately be detected.

In the present embodiment, there is adopted the configuration in which the head chips 52A, 52B respectively have the actuator plates 55, 71, and the cover plates 56, 72.

According to this configuration, the ink flowing through the respective ink flow channels 81, 155 inflows into the ejection channels 57 of the head chips 52A, 52B through the common ink chambers 62 of the corresponding head chips 52A, 52B, respectively. In this case, since the capacity of the part (the common ink chamber 62) from the ink flow channels 81, 155 to the ejection channels 57 can be set equivalent between the head chips 52A, 52B, it is possible to equalize the ejection characteristics of the head chips 52A, 52B.

In the present embodiment, since the inkjet heads 5A, 5B described above are provided, it is possible to provide the printer 1 small in size.

It should be noted that the scope of the invention is not limited to the embodiment described above, but various modifications can be applied within the scope or the spirit of the invention.

For example, in the embodiment described above, the description is presented citing the inkjet printer 1 as an example of the liquid jet device, but the printer is not a limitation. For example, a facsimile machine, an on-demand printing machine, and so on can also be adopted.

In the embodiment described above, there is described the configuration in which the two jet modules 30A, 30B are mounted on the base member 38, but the invention is not limited only to this configuration. The number of the jet modules mounted on the base member 38 can also be one, or a plural number equal to or more than three.

In the embodiment described above, the head chips of an edge shoot type are described, but the invention is not limited to this type. For example, it is also possible to apply the invention to a head chip of a so-called side shoot type for ejecting the ink from a central part in the extending direction in the ejection channel.

Further, it is also possible to apply the invention to a head chip of a so-called roof shoot type in which the direction of the pressure applied to the ink and the ejection direction of the ink are made to coincide with each other.

In the embodiment described above, there is described the configuration in which the head chips 52A, 52B themselves are provided with the communication holes 73, but the invention is not limited only to this configuration. It is also possible to provide a communication flow channel for communicating the head chips 52A, 52B with each other separately from the head chips 52A, 52B.

In the embodiment described above, there is described the configuration in which the Z direction coincides with the gravitational direction, but the invention is not limited only to this configuration, and it is also possible to make the Z direction coincide with the horizontal direction.

Besides the above, it is arbitrarily possible to replace the constituents in the embodiment described above with known constituents within the scope or the spirit of the invention, and it is also possible to arbitrarily combine the modified examples described above.

What is claimed is:

1. A liquid jet head comprising:

a first head chip and a second head chip stacked on one another in a first direction, and each adapted to jet liquid;

a first flow channel member disposed on an opposite side of the first head chip to the second head chip in the first direction, and including an inflow port communicated with a supply source of the liquid and a first liquid flow channel adapted to communicate the inflow port and the first head chip with each other;

a second flow channel member disposed on an opposite side of the second head chip to the first head chip in the first direction, and including a second liquid flow channel communicated with the second head chip; and a communication flow channel located between the first flow channel member and the second flow channel member, and adapted to communicate the first liquid flow channel and the second liquid flow channel with each other, wherein the first liquid flow channel includes a first supply flow channel opening the first head chip, the liquid flowing through the first supply flow channel inflowing into the first head chip, and the second liquid flow channel includes a second supply flow channel opening the second head chip, the liquid flowing through the second supply flow channel inflowing into the second head chip.

2. The liquid jet head according to claim 1, wherein the communication flow channel is a penetration hole adapted to penetrate the first head chip and the second head chip in the first direction.

3. The liquid jet head according to claim 1, wherein the first flow channel member supports a drive board adapted to drive any of the first head chip and the second head chip.

4. The liquid jet head according to claim 3, wherein a first driver adapted to drive the first head chip and a second driver adapted to drive the second head chip are mounted on the drive board, the first head chip and the first driver are electrically connected to each other via the drive board, and the second head chip and the second driver are electrically connected to each other via a wiring board branched from the drive board.

5. The liquid jet head according to claim 1, wherein a temperature sensor adapted to detect a temperature of the liquid is installed in the second flow channel member.

6. The liquid jet head according to claim 1, wherein the first head chip includes a first actuator plate provided with a jet channel into which the liquid inflows, and a first cover plate stacked on the first actuator plate in the first direction, and provided with a liquid chamber adapted to connect the jet channel and the first liquid flow channel to each other, and the second head chip includes a second actuator plate provided with a jet channel into which the liquid inflows, and stacked on the first actuator plate on an opposite side to the first cover plate in the first direction, and a second cover plate stacked on the second actuator plate in the first direction, and provided with a liquid chamber adapted to connect the jet channel and the second liquid flow channel to each other.

7. A liquid jet device comprising:

the liquid jet head according to claim 1.

* * * * *